US006677111B1

(12) United States Patent
Ikari

(10) Patent No.: US 6,677,111 B1
(45) Date of Patent: Jan. 13, 2004

(54) SILVER HALIDE EMULSION, PRODUCTION PROCESS THEREOF, AND SILVER HALIDE PHOTOGRAPHIC LIGHT-SENSITIVE MATERIAL AND PHOTOTHERMOGRAPHIC MATERIAL USING THE SAME

(75) Inventor: Shinji Ikari, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/522,183

(22) Filed: Mar. 9, 2000

(30) Foreign Application Priority Data

Mar. 26, 1999 (JP) ..... 11-084182

(51) Int. Cl.[7] ..... G03C 1/035

(52) U.S. Cl. ..... 430/567; 430/569; 430/618; 430/620

(58) Field of Search ..... 430/567, 569, 430/618, 620

(56) References Cited

U.S. PATENT DOCUMENTS

| | | | | | |
|---|---|---|---|---|---|
| 4,725,534 | A | * | 2/1988 | Kagami et al. | 430/619 |
| 5,310,644 | A | * | 5/1994 | Delton | 430/567 |
| 5,434,043 | A | * | 7/1995 | Zou et al. | 430/619 |
| 5,503,971 | A | * | 4/1996 | Daubendiek et al. | 430/567 |
| 5,523,200 | A | * | 6/1996 | Hahm et al. | 430/569 |
| 5,558,981 | A | * | 9/1996 | Bayley | 430/567 |
| 5,563,030 | A | * | 10/1996 | Zou et al. | 430/619 |
| 5,641,618 | A | * | 6/1997 | Wen et al. | 430/567 |
| 5,744,287 | A | * | 4/1998 | Roberts et al. | 430/363 |
| 5,858,638 | A | * | 1/1999 | Maskasky et al. | 430/569 |
| 5,902,721 | A | * | 5/1999 | Becher et al. | 430/541 |
| 5,908,739 | A | * | 6/1999 | Chang et al. | 430/567 |
| 5,916,742 | A | * | 6/1999 | Ikari et al. | 430/569 |
| 5,919,611 | A | * | 7/1999 | Maruyama | 430/567 |
| 6,040,129 | A | * | 3/2000 | Godleski et al. | 430/604 |
| 6,214,532 | B1 | * | 4/2001 | Bollen | 430/569 |

FOREIGN PATENT DOCUMENTS

| | | |
|---|---|---|
| JP | 220853 | 1/1990 |
| JP | 220854 | 1/1990 |

OTHER PUBLICATIONS

Research Disclosure, vol. 176, No. 17643.
Research Disclosure, vol. 367, No. 36736.

* cited by examiner

*Primary Examiner*—Janet Baxter
*Assistant Examiner*—Amanda C. Walke
(74) *Attorney, Agent, or Firm*—Birch, Stewart, Kolasch & Birch

(57) ABSTRACT

A silver halide emulsion is described, comprising at least a dispersion medium and silver halide grains, wherein said silver halide grains have an average grain size of from 0.005 to 0.1 $\mu$m and a hexacyano metal complex represented by formula (I) is present on the outermost surface of the silver halide grain:

$$[M(CN)_6]^{n-} \quad (I)$$

wherein M represents Fe, Ru, Os, Co, Rh, Ir, Cr or Re, and n represents 3 or 4. Also described are a method for producing the emulsion, and a silver halide light-sensitive material and a photothermographic material using the emulsion.

22 Claims, No Drawings

SILVER HALIDE EMULSION, PRODUCTION PROCESS THEREOF, AND SILVER HALIDE PHOTOGRAPHIC LIGHT-SENSITIVE MATERIAL AND PHOTOTHERMOGRAPHIC MATERIAL USING THE SAME

FIELD OF THE INVENTION

The present invention relates to silver halide emulsion, a production process thereof, and a silver halide photographic light-sensitive material and a photothermographic material each having a layer comprising the emulsion.

BACKGROUND OF THE INVENTION

Silver halide as a photosensitive element of photographic light-sensitive materials can be formed to have a grain size of 0.01 μm or more by appropriately designing the preparation process in a photographic gelatin. However, silver halide grains having a grain size of from 0.005 to 0.1 μm undergo physical ripening with the passing of time, where small grains dissolve to grow into large grains. As a result, the grain size disadvantageously becomes large.

In order to prevent the growing of silver halide grains into large grains, a stabilizer for stabilizing the photographic performance, such as tetrazaindenes and mercaptothiazoles, has been conventionally used. However, if the stabilizer is added in an amount large enough to fix the grain size, a spectral sensitizing dye does not adsorb to the grain surface and a photographic light-sensitive material using the emulsion cannot have a desired sensitivity. Thus, it has been difficult to attain results in both the grain size and the photographic performance. In particular, silver chloride fine grain has high solubility and the physical ripening thereof is hard to prevent. If the grain size of this silver halide fine grain can be maintained, various advantages can be provided, for example, the storability of emulsion can be increased or a large number of grains can be obtained with the same silver amount.

These advantages can be applied to photothermographic materials. In the photothermographic material, the silver halide grain works as a photosensitive element and by forming the silver halide grains as fine grains, the silver amount can be reduced and thereby the storability can be improved. The photothermographic material is described below.

In the medical diagnosis field, reduction in the amount of processing waste solution is keenly demanded in recent years from the viewpoint of environmental conservation and space savings. To cope with this demand, technology is required relating to photothermographic materials for use in medical diagnosis or graphic art or other photographic use, which can be effectively exposed by a laser image setter or a laser imager and can form a sharp black image having high resolution and sharpness. These photothermographic materials can dispense with processing chemicals of solution system and afford users a more simple heat-developing system which does not impair the environment.

The same is also demanded in the field of general image-forming materials, however, the image for medical diagnosis use must be finely drawn, therefore, must have a high image quality with good sharpness and excellent graininess. Furthermore, in view of diagnostic convenience, an image of blue black image tone is preferred. At the present, various hard copy systems using a pigment or a dye are commercially available, such as ink jet printer and electrophotography, however, these are not a satisfactory output system for the image in medical use.

On the other hand, (photo)thermographic systems using a silver salt of an organic acid are described, for example, in U.S. Pat. Nos 3,152,904 and 3,457,075, D. Klosterboer, *Thermally Processed Silver Systems*, and J. Sturge, V. Walworth and A. Shepp (compilers), *Imaging Processes and Materials*, 8th ed., chapter 9th, page 279, Neblette (1989). In particular, photothermographic materials generally have a light-sensitive layer comprising a binder matrix having dispersed therein a catalytic amount of a photocatalyst (for example, silver halide), a reducing agent, a reducible silver salt (for example, a silver salt of an organic acid) and if desired, a toner for controlling the silver tone. The photothermographic material after image exposure is heated at a high temperature (for example, 80° C. or more) to cause an oxidation-reduction reaction between the silver halide or reducible silver salt (acting as an oxidizing agent) and the reducing agent and thereby form a black silver image. The oxidation-reduction reaction is accelerated by the catalytic action of a silver halide latent image produced by the exposure. Therefore, the black silver image is formed in the exposed area. This is disclosed in a large number of publications including U.S. Pat. No. 2,910,377 and JP-B-43-4924 (the term "JP-B" as used herein means an "examined Japanese patent publication") The (photo) thermographic system using a silver salt of an organic acid can provide an image satisfied in the image quality and the tone for medical diagnosis uses.

Silver halide emulsions produced by adding a hexacyano metal complex during or after the formation of silver halide grains are described in *Research Disclosure*, Vol. 176, No. 17643, Item IA (1978) and Vol. 367, Item 36736 (1994), JP-A-2-20853 (the term "JP-A" as used herein means an "unexamined published Japanese patent application") and JP-A-2-20854. In these publications, a technique of incorporating (doping) a hexacyano metal complex into the inside of a silver halide grain. However, these silver halide emulsions are not yet satisfied in the sensitivity and the storability and still in need of improvements.

SUMMARY OF THE INVENTION

An object of the present invention is to provide a silver halide grain emulsion having a small grain size.

Another object of the present invention is to provide a silver halide photographic light-sensitive material having high sensitivity and excellent image preservability against light.

A still another object of the present invention is photothermographic material having high sensitivity and excellent image preservability against light.

The above-described objects can be attained by the following means.

(1) A silver halide emulsion comprising at least a dispersion medium and silver halide grains, wherein the silver halide grains have an average grain size of from 0.005 to 0.1 μm and a hexacyano metal complex represented by formula (I) is present on the outermost surface of the silver halide grain:

$$[M(CN)_6]^{n-} \quad (I)$$

wherein M represents Fe, Ru, Os, Co, Rh, Ir, Cr or Re, and n represents 3 or 4.

(2) The silver halide emulsion as described in (1) above, wherein the silver halide grain contains in the inside thereof a coordination metal complex or metal ion containing a metal belonging to the elements of Group III to Group XIV of the Periodic Table.

(3) The silver halide emulsion as described in (2) above, wherein the coordination metal complex contained in the inside of the silver halide grain is a compound represented by formula (III):

$$[M1(CN)_6]^{n1-} \quad (III)$$

wherein M1 represents Fe, Ru, Os, Co, Rh, Ir, Cr or Re, and n1 represents 3 or 4.

(4) The silver halide emulsion as described in (2) or (3) above, wherein the coordination metal complex contained in the inside of the silver halide grain is an iridium complex.

(5) The silver halide emulsion as described in any one of (1) to (4) above, wherein the silver halide emulsion is chalcogen sensitized.

(6) The silver halide emulsion as described in any one of (1) to (5) above, wherein the silver halide grains are formed in the presence of an oxidizing agent for silver.

(7) The silver halide emulsion as described in any one of (1) to (6) above, wherein the silver halide emulsion is chemically sensitized in the presence of a spectral sensitizing dye.

(8) A method for producing a silver halide emulsion comprising silver halide grains having an average grain size of from 0.005 to 0.1 $\mu$m, wherein a hexacyano metal complex represented by the following formula (I) is added after the addition of an aqueous silver nitrate solution used for the grain formation is completed but before starting the chemical sensitization process:

$$[M(CN)_6]^{n-} \quad (I)$$

wherein M represents Fe, Ru, Os, Co, Rh, Ir, Cr or Re, and n represents 3 or 4.

(9) A silver halide light-sensitive material comprising a support having thereon at least one light-sensitive layer comprising the silver halide emulsion described in any one of (1) to (7) above.

(10) A photothermographic material comprising a support having thereon at least one light-sensitive layer containing a light-sensitive silver halide, a light-insensitive silver salt of an organic fatty acid, a reducing agent for silver ion and a binder, wherein a silver halide emulsion described in any one of (1) to (7) above is prepared independently of the silver salt of the organic fatty acid and mixed with the silver salt of the organic fatty acid at the coating and the mixture is coated and dried to form the light-sensitive layer.

DETAILED DESCRIPTION OF THE INVENTION

The present invention is described in detail below.

In the present invention a hexacyano metal complex represented by the following formula (I) (hereinafter sometimes referred to as "a hexacyano metal complex of the present invention") is used $$[M(CN)_6]^{n-} \quad (I)$$

wherein M represents Fe, Ru, Os, Co, Rh, Ir, Cr or Re, and n represents 3 or 4. M is preferably Fe or Ru, more preferably Fe.

Specific examples of the compound are set forth below.

(I-1) $[Fe(CN)_6]^{4-}$ (I-2) $[Fe(CN)_6]^{3-}$ (I-3) $[Ru(CN)_6]^{4-}$ (I-4) $[Os(CN)_6]^{4-}$ (I-5) $[Co(CN)_6]^{3-}$ (I-6) $[Rh(CN)_6]^{3-}$ (I-7) $[Ir(CN)_6]^{3-}$ (I-8) $[Cr(CN)_6]^{3-}$ (I-9) $[Re(CN)_6]^{3-}$

The hexacyano metal complex of the present invention is present in the form of ion in an aqueous solution, therefore, the counter cation is not important but a cation easy to mix with water and suitable for the precipitation operation of a silver halide emulsion is preferred. Examples thereof include alkali metal ions such as sodium ion, potassium ion, rubidium ion, cesium ion and lithium ion, ammonium ions, and alkylammonium ions represented by the following formula (II):

$$[R_1R_2R_3R_4N]^+ \quad (II)$$

wherein $R_1$, $R_2$, $R_3$ and $R_4$ each represents a substituent freely selected from alkyl groups such as a methyl group, an ethyl group, a propyl group, an iso-propyl group and an n-butyl group. Among these, compounds where $R_1$, $R_2$, $R_3$ and $R_4$ are the same are preferred, such as tetramethylammonium ion, tetraethylammonium ion, tetrapropylammonium ion and tetra(n-butyl)ammonium ion.

The hexacyano metal complex of the present invention may be added after mixing it with water, a mixed solvent of water and an appropriate organic solvent miscible with water (for example, alcohols, ethers, glycols, ketones, esters and amides), or gelatin.

The amount of the hexacyano metal complex of the present invention added is preferably $1\times10^{-5}$ to $1\times10^{-2}$ mol, more preferably from $1\times10^{-4}$ to $1\times10^{-3}$ mol, per mol of silver.

For allowing the hexacyano metal complex of the present invention to be present on the outermost surface of a silver halide grain, the hexacyano metal complex of the present invention is directly added after the addition of an aqueous silver nitrate solution used for the grain formation is completed but before starting the chemical sensitization process by performing chalcogen sensitization such as sulfur sensitization, selenium sensitization and tellurium sensitization or noble metal sensitization such as gold sensitization, for example, before the completion of charging process, during the water washing process, during the dispersing process or before the chemical sensitization process. In order to prevent growing of silver halide fine grains, the hexacyano metal complex is preferably added without delay after the grain formation but before the completion of charging process.

The addition of hexacyano metal complex is started after 96 wt %, preferably 98 wt %, more preferably 99 wt %, of the total amount of silver nitrate added for forming grains is added.

By the studies this time, it is found that the hexacyano metal complex added after the addition of an aqueous silver nitrate solution immediately before the completion of grain formation adsorbs to the outermost surface of a silver halide grain. Most of the complexes adsorbed form a sparingly-soluble salt with silver ion on the grain surface. The silver salt of hexacyanoferrate (II) formed is a salt more sparingly soluble than AgI, therefore, the redissolving of fine grains can be prevented and silver halide fine grains having a small grain size can be produced.

The silver halide emulsion of the present invention is a photographic silver halide emulsion comprising silver halide grains having an average grain size of from 0.005 to 0.1 $\mu$m (in the present invention, sometimes referred to as a "silver halide fine grain of the present invention") When the silver halide grain is a so-called regular crystal having, for example, a cubic or octahedral form, and when it is a so-called irregular crystal having, for example, a spherical or bar form, the grain size as used herein means the diameter of an imaginary sphere having the same volume as the silver halide grain (sphere-equivalent size). When the silver halide grain is a tabular grain, the grain size means the diameter of an imaginary circle having the same area as the projected area of a main face (circle-equivalent size). In the present invention, the average grain size is preferably from 0.008 to 0.07 $\mu$m, more preferably from 0.010 to 0.060 $\mu$m. The grain size can be confirmed by an electron microscope.

Examples of the shape of silver halide grain include cubic form, octahedral form, tabular form, spherical form, bar form and pebble form. In the present invention, cubic grain is preferred. A silver halide grain having rounded corners may also be used. The face index (Miller indices) of the outer surface plane of a light-sensitive silver halide grain is not particularly limited, however, it is preferred that the occupation ratio of [100] faces readily causing the interaction of hexacyano metal ion and silver ion is high. The occupation ratio is preferably 50% or more, more preferably 65% or more, still more preferably 80% or more. The percentage of [100] faces according to the Miller indices can be obtained by the method described in T. Tani, *J. Imaging Sci.*, 29, 165 (1985) using the adsorption dependency of [111] face and [100] face upon adsorption of the sensitizing dye.

The halogen composition of silver halide grains for use in the present invention is not particularly limited, and silver chloride, silver chlorobromide, silver bromide, silver iodobromide and silver iodochlorobromide may be used. The halogen composition distribution within the grain may be uniform or the halogen composition may be stepwise changed or continuously changed. A silver halide grain having a core/shell structure may also be preferably used. With respect to the structure, the core/shell grain preferably has from 2 to 5-ply structure, more preferably from 2 to 4-ply structure. Furthermore, a technique of localizing silver bromide on the surface of silver chloride or silver chlorobromide grains may also be preferably used. The emulsion of the present invention preferably has a silver iodide content of from 0 to 5 mol %.

In the present invention, a silver halide grain having a dislocation line may also be preferably used. The grain having a dislocation line is disclosed in U.S. Pat. No. 4,806,461.

In the present invention, the silver halide grain preferably contains in the inside thereof a coordination metal complex or metal ion containing a metal belonging to the elements of Groups III to XIV of the periodic table. The metal of the coordination metal complex or metal ion may be selected from the elements of Groups III to XIV in the periodic table having Group numbers of I to XVIII from the left. The metal is preferably selected from the metals belonging to the elements of Groups IV, V and VI of the periodic table, more preferably from vanadium, chromium, manganese, iron, cobalt, nickel, niobium, molybdenum, ruthenium, rhodium, palladium, tantalum, tungsten, rhenium, osmium, iridium, platinum and lead. The metal is particularly preferably an iridium complex. The metal may be used as a metal ion in the form of a metal salt such as ammonium salt, acetate, nitrate, sulfate, phosphate and hydroxide, however, by using the meal as a mononuclear coordination metal salt such as hexacoordinated complex salt or tetracoordinated complex salt, or as a polynuclear or multinuclear metal complex salt, the performance owing to the ligand or complex salt structure may be brought out. Preferred examples of the ligand include anionic ligands such as fluoride ion, chloride ion, bromide ion, iodide ion, oxide ion, sulfide ion, selenide ion, telluride ion, cyanide ion, thiocyanide ion, selenocyanide ion, tellurocyanide ion, cyanate ion, nitride ion and azide ion, neutral ligands such as water, carbonyl, nitrosyl, thionitrosyl and ammonia, and organic ligands containing one or more carbon-carbon, carbon-hydrogen or carbon-nitrogen-hydrogen bond, such as 4,4'-bipyridine, pyrazine and thiazole disclosed in U.S. Pat. No. 5,360,712.

Specific examples of the metal ion include those described in *Comprehensive Coordination Chemistry*, Pergamon Press (1987).

For the doping into a silver halide grain, the coordination metal complex or metal ion of the present invention is preferably added directly to the reaction solution during the formation of silver halide grains or added to the reaction solution for the grain formation after adding it to a solution containing halide ion for forming silver halide grains or other solution. Furthermore, various adding methods may be used in combination.

The coordination metal complex or metal ion of the present invention may be doped to uniformly reside inside the grain or as disclosed in JP-A-4-208936, JP-A-2-125245 an JP-A-3-188437, may be doped in a higher concentration in the grain surface phase. Also, as disclosed in U.S. Pat. No. 5,256,530, the grain surface phase may be modified by physically ripening it with the doped fine grains. This method of preparing doped fine grains and adding the fine grains to physically ripen and thereby dope silver halide grains is preferably used. These doping methods may also be used in combination.

The coordination metal complex or metal ion capable of satisfying the requirements in the present invention may be incorporated into a silver halide grain in the same concentration per mol of silver as conventionally used for the doping of transition metals. Concentrations over a very wide range are known and the coordination metal complex or metal ion may be used in a concentration of from a low concentration of $10^{-10}$ mol per mol of silver disclosed in JP-A-51-107129 to a high concentration of $10^{-3}$ mol per mol of silver disclosed in U.S. Pat. Nos. 3,687,676 and 3,690,891. The effective concentration greatly varies depending on the amount of halide in the grain, the coordination complex or metal ion selected, the oxidation state thereof, the kind of ligand, if present, and the desired photographic effects.

The doped amount or doping ratio of the coordination metal complex or metal ion of the present invention in a silver halide grain may be determined by measuring the metal ion doped using atomic absorption method, ICP method (inductively coupled plasma spectrometry), ICPMS method (inductively coupled plasma mass spectrometry) or the like.

Among these coordination metal complexes which can be incorporated into the silver halide grain, the hexacyano metal complex represented by formula (III) is preferred:

$$[M1(CN)_6]^{n1-} \quad \text{(III)}$$

wherein M1 represents Fe, Ru, Os, Co, Rh, Ir, Cr or Re, and n1 represents 3 or 4.

Specific examples of the compound are the same as those of the compound represented by formula (I).

The coordination metal complex or metal ion may be added after mixing it with water, a mixed solvent of water and an appropriate organic solvent miscible with water (for example, alcohols, ethers, glycols, ketones, esters and amides), or gelatin.

The coordination metal complex or metal ion is preferably added directly to the reaction solution at the formation of silver halide grains or incorporated by adding it to an aqueous halide solution for forming silver halide grains or other solution and then subjecting the solution to the grain formation. Furthermore, a method of adding the coordination metal complex or metal ion using fine grains doped with the metal ion of the present invention may be used. These adding methods may also be used in combination.

The amount of coordination metal complex or metal ion added is preferably from $1\times10^{-8}$ to $1\times10^{-3}$ mol, more preferably from $1\times10^{-7}$ to $1\times10^{-4}$ mol, per mol of silver.

With respect to the position where the coordination metal complex or metal ion is doped, the localized phase having a coordination metal complex or metal ion concentration at least 10 times higher than other parts is present in the surface phase which occupies 50% or less, preferably 30% or less, of the grain volume. The coordination metal complex or metal ion may also be doped in an epitaxial phase formed on the grain surface.

Iridium Metal

As the metal complex which can be incorporated into a silver halide grain, an iridium complex is preferably used in combination. The iridium complex includes trivalent iridium complex and tetravalent iridium complex. Examples thereof include hexachloroiridium(III) complex salt, hexachloroiridium(IV) complex salt, hexabromoiridium(III) complex salt, hexabromoiridium(IV) complex salt, hexaiodoiridium(III) complex salt, hexaiodoiridium(IV) complex salt, aquapentachloroiridium(III) complex salt, aquapentachloroiridium(IV) complex salt, aquapentabromoiridium(III) complex salt, aquapentabromoiridium(IV) complex salt, aquapentaiodoiridium(III) complex salt, aquapentaiodoiridium(IV) complex salt, diaquatetrachloroiridium(III) complex salt, diaquatetrachloroiridium(IV) complex salt, diaquatetrabromoiridium(III) complex salt, diaquatetrabromoiridium(IV) complex salt, diaquatetraiodoiridium(III) complex salt, diaquatetraiodoiridium(IV) complex salt, triaquatrichloroiridium(III) complex salt, triaquatrichloroiridium(IV) complex salt, triaquatribromoiridium(III) complex salt, triaquatribromoiridium(IV) complex salt, triaquatriiodoiridium(III) complex salt, triaquatriiodoiridium(IV) complex salt, hexammineiridium (III) complex salt and hexammineiridium(IV) complex salt, however, the present invention is by no means limited thereto.

The amount of the iridium complex added is preferably from $10^{-9}$ to $10^{-3}$ mol, more preferably from $10^{-6}$ to $10^{-4}$ mol, per mol of silver halide.

Chalcogen Sensitization

The silver halide emulsion of the present invention is preferably sensitized using sulfur sensitization, selenium sensitization or tellurium sensitization solely or using a plurality of these sensitization treatments.

The sulfur sensitization preferably used in the present invention is usually performed by adding a sulfur sensitizer and stirring the emulsion at a high temperature of 40° C. or more for a predetermined time. The sulfur sensitizer used may be a known compound. For example, in addition to the sulfur compound contained in gelatin, various sulfur compounds such as thiosulfates, thioureas, thiazoles and rhodanines may be used. Among these, preferred are a thiosulfate and a thiourea compound. The amount of the sulfur sensitizer varies depending on various conditions such as pH, temperature and silver halide grain size at the chemical ripening, however, it is usually from $1\times10^{-7}$ to $1\times10^{-2}$ mol, preferably from $1\times10^{-5}$ to $1\times10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound which can be used include the compounds described in JP-B-44-15748, JP-B-43-13489, JP-A-4-25832, JP-A-4-109240 and JP-A-3-121798. In particular, the compounds represented by formulae (VIII) and (IX) of JP-A-4-324855 are preferred.

The tellurium sensitizer for use in the present invention is a compound of forming silver telluride presumed to become a sensitization nucleus, on the surface or in the inside of a silver halide grain. The rate of formation of silver telluride in a silver halide emulsion can be examined according to the method described in JP-A-5-313284. Examples of the tellurium sensitizer include diacyltellurides, bis(oxycarbonyl) tellurides, bis-(carbamoyl)tellurides, bis(oxycarbonyl) ditellurides, bis(carbamoyl)ditellurides, compounds having a P=Te bond, tellurocarboxylates, Te-organyltellurocarboxylic acid esters, di(poly)tellurides, tellurides, telluroles, telluroacetals, tellurosulfonates, compounds having a P—Te bond, Te-containing heterocyclic compounds, tellurocarbonyl compounds, inorganic tellurium compounds and colloidal tellurium. Specific examples of the tellurium sensitizer which can be used include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-3-53693, JP-A-3-131598, JP-A-4-129787, *J. Chem. Soc. Chem. Commun.*, 635 (1980), *ibid.*, 1102 (1979), *ibid.*, 645 (1979), *J. Chem. Soc. Perkin. Trans.* 1, 2191 (1980), S. Patai (compiler), *The Chemistry of Organic Selenium and Tellurium Compounds*, Vol. 1 (1986), and *ibid.*, Vol. 2 (1987). In particular, the compounds represented by formulae (II), (III) and (IV) of JP-A-5-313284 are preferred.

The used amount of the selenium or tellurium sensitizer for use in the present invention varies depending on silver halide grain used, chemical ripening conditions and the like, however, it is usually from $1\times10^{-8}$ to $1\times10^{-2}$ mol, preferably on the order of from $1\times10^{-7}$ to $1\times10^{-3}$ mol, per mol of silver halide. The conditions for chemical sensitization in the present invention are not particularly limited, however, the pH is from 5 to 8, the pAg is from 6 to 11, preferably from 7 to 10, and the temperature is from 40 to 95° C., preferably from 45 to 85° C.

The silver halide emulsion of the present invention may also be sensitized using a combination of chalcogen sensitization with gold sensitization or reduction sensitization. When the chalcogen sensitization is used in combination with gold sensitization, for example, a combinations of sulfur sensitization and gold sensitization, a combination of selenium sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization are preferred.

Gold Sensitization

In the case of applying gold sensitization, the gold sensitizer used may have a gold oxidation number of either +1 valence or +3 valence. Gold compounds commonly used as the gold sensitizer may also be used. Representative examples thereof include chloroauric acid, potassium chloroaurate, auric trichloride, potassium auric thiocyanate, potassium iodoaurate, tetracyanoauric acid, ammonium aurothiocyanate and pyridyltrichlorogold.

The amount of the gold sensitizer added varies depending on various conditions, however, as a standard, it is from $1\times10^{-7}$ to $1\times10^{-3}$ mol, preferably from $1\times10^{-5}$ to $1\times10^{-4}$ mol, per mol of silver halide.

Reduction Sensitization

The silver halide emulsion of the present invention may be sensitized using reduction sensitization. Specific examples of the reduction sensitizer which can be used include ascorbic acid, thiourea dioxide, stannous salt, aminoiminomethanesulfinic acid, hydrazine derivatives, borane compounds, silane compounds and polyamine compounds. The reduction sensitization may also be performed by ripening the emulsion while maintaining the pH at 7 or more and the pAg at 8.3 or less. Furthermore, the reduction sensitization may be performed by introducing the single addition moiety of silver ion during the grain formation.

To the silver halide emulsion of the present invention, a thiosulfonic acid compound may be added by the method described in European Patent 293,917.

In the silver halide emulsion of the present invention, a cadmium salt, a sulfite, a lead salt or a thallium salt may be allowed to be present together during the formation or physical ripening of silver halide grains.

In the light-sensitive material of the present invention, a sole kind of silver halide emulsion may be used or two or more kinds of silver halide emulsions (for example, different in the average grain size, different in the halogen composition, different in the crystal habit or different in the conditions of chemical sensitization) may be used in combination.

Sensitizing Dye

The sensitizing dye for use in the present invention may be any as long as it can adsorb to a silver halide grain and spectrally sensitize the silver halide grain in the desired wavelength region (600 nm or more). Examples of the sensitizing dye which can be used include a cyanine dye, a merocyanine dye, a complex cyanine dye, a complex merocyanine dye, a holopolar cyanine dye, a styryl dye, a hemicyanine dye, an oxonol dye and a hemioxonol dye. Useful sensitizing dyes for use in the present invention are described, for example, in *Research Disclosure*, Item 17643 IV-A, page 23 (December, 1978), *ibid.*, Item 1831 X, page 437 (August, 1979), and publications cited therein. In particular, sensitizing dyes having spectral sensitivity suitable for spectral characteristics of the light source in various laser imagers, scanners, image setters and photomechanical cameras can be advantageously selected.

For the red light source in the spectral sensitization to red light, such as He—Ne laser, red semiconductor laser and LED, the sensitizing dye may be advantageously selected from Compounds I-1 to I-38 of JP-A-54-18726, Compounds I-1 to I-35 of JP-A-6-75322, Compounds I-1 to I-34 of JP-A-7-287338, Dyes 1 to 20 of JP-B-55-39818, Compounds I-1 to I-37 of JP-A-62-284343, and Compounds I-1 to I-34 of JP-A-7-287338.

For the semiconductor laser light source in the wavelength region of from 750 to 1,400 nm, various known dyes including cyanine, merocyanine, styryl, hemicyanine, oxonol, hemioxonol and xanthene dyes may be used and by these dyes, the emulsion can be spectrally sensitized in an advantageous manner. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus and imidazole nucleus. Preferred examples of useful merocyanine dyes include, in addition to those having the above-described basic nucleus, dyes having an acidic nucleus such as thiohydantoin nucleus, rhodanine nucleus, oxazolidine-dione nucleus, thiazolinedione nucleus, barbituric acid nucleus, thiazolinone nucleus, malononitrile nucleus and pyrazolone nucleus. Among these cyanine and merocyanine dyes, those having an imino group or a carboxyl group are particularly effective. The sensitizing dye may be appropriately selected from known dyes described, for example, in U.S. Pat. Nos. 3,761,279, 3,719,495 and 3,877,943, British Patents 1,466,201, 1,469,117 and 1,422,057, JP-B-3-10391, JP-B-6-52387, JP-A-5-341432, JP-A-6-194781 and JP-A-6-301141.

Particularly preferred examples of the structure of the dye for use in the present invention include cyanine dyes having a thioether bond-containing substituent group (for example, dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, Japanese Published Unexamined International Application 7-500926 and U.S. Pat. No. 5,541,054), dyes having a carboxylic acid group (for example, dyes described in JP-A-3-163440, JP-A-6-301141 and U.S. Pat. No. 5,441,899), merocyanine dyes, polynuclear merocyanine dyes and polynuclear cyanine dyes (for example, dyes described in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, Japanese Published Unexamined International Application 55-50111, British Patent 1,467,638 and U.S. Pat. No. 5,281,515).

Also, dyes capable of forming J-band disclosed in U.S. Pat. Nos. 5,510,236 and 3,871,887 (dye described in Example 5), JP-A-2-96131 and JP-A-59-48753 may be preferably used in the present invention.

In the present invention, merocyanine dyes which have been heretofore scarcely used in the addition prior to chemical sensitization because of their weak adsorption are particularly preferred.

These sensitizing dyes may be used individually or in combination of two or more thereof. In particular, the combination of sensitizing dyes is often used for the purpose of supersensitization. In combination with the sensitizing dye, a dye which itself has no spectral sensitization effect or a material which absorbs substantially no visible light, but which exhibits supersensitization may be contained in the emulsion. Useful sensitizing dyes, combinations of dyes which exhibit supersensitization, and materials which exhibit supersensitization are described in *Research Disclosure*, Vol. 176, 17643, page 23, Item IV-J (December, 1978), JP-B-49-25500, JP-B-43-4933, JP-A-59-19032 and JP-A-59-192242.

For adding the sensitizing dye to a silver halide emulsion, the dye may be directly dispersed in the silver halide emulsion or may be added to the emulsion after dissolving it in a sole or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide.

Also, the sensitizing dye may be added to the emulsion by a method described in U.S. Pat. No. 3,469,987 where a dye is dissolved in a volatile organic solvent, the solution is dispersed in water or a hydrophilic colloid and the dispersion is added to the emulsion, a method described in JP-B-44-23389, JP-B-44-27555 and JP-B-57-22091 where a dye is dissolved in an acid and the solution is added to the emulsion or formed into an aqueous solution in the presence of,an acid or a base together and then added to the emulsion, a method described in U.S. Pat. Nos. 3,822,135 and 4,006,025 where a dye is formed into an aqueous solution or a colloid dispersion in the presence of a surface active agent together and the aqueous solution or dispersion is added to the emulsion, a method described in JP-A-53-102733 and JP-A-58-105141 where a dye is directly dispersed in a hydrophilic colloid and the dispersion is added to the emulsion, or a method described in JP-A-51-74624 where a dye is dissolved using a compound capable of red-shift and the solution is added to the emulsion. Ultrasonic waves may also be used in the solution.

The sensitizing dye for use in the present invention may be added to a silver halide emulsion of the present invention in any process known to be useful during the preparation of emulsion. For example, the dye may be added in the period during the formation of silver halide grains and/or before desalting or in the period during desalting and/or after desalting but before initiation of the chemical ripening as disclosed in U.S. Pat. Nos. 2,735,766, 3,628,960, 4,183,756 and 4,225,666, JP-A-58-184142 and JP-A-60-196749, or the dye may be added in any period or any process if it is before the coating of the emulsion, such as in the period immediately before or during chemical ripening and in the period after chemical ripening but before coating as described in JP-A-58-113920. Also, a sole kind of compound alone or compounds different in the structure in combination may be added in parts, for example, one part during the grain formation and the remaining during the chemical ripening or after the completion of chemical ripening, or one part before or during the chemical ripening and the remaining after the completion of chemical ripening as disclosed in U.S. Pat. No. 4,225,666 and JP-A-58-7629. The kind of compounds added in parts or the kind of the combination of compounds may be changed.

As such, various adding methods may be used, however, the sensitizing dye must be added to be present at the chemical sensitization.

The sensitizing dye for use in the present invention may be used in a desired amount according to the performance such as sensitivity and fogging, however, the amount used is preferably from $10^{-6}$ to 1 mol, more preferably from $10^{-4}$ to $10^{-1}$ mol, per mol of silver halide in the light-sensitive layer.

The silver halide emulsion of the present invention may be further protected against production of additional fogging or stabilized against reduction in the sensitivity during stock storage, by an antifoggant, a stabilizer or a stabilizer precursor. Examples of suitable antifoggants, stabilizers and stabilizer precursors which can be used individually or in combination, include those described in JP-A-10-62899 (paragraph 0070) and Unexamined European Patent Publication No. 0803764A1 (page 20, line 57 to page 21, line 7).

The antifoggant preferably used in the present invention is an organic halide and examples thereof include the compounds disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

The antifoggant for use in the present invention may be added by any method such as solution, powder or solid fine particle dispersion. The solid fine particle dispersion is prepared by a known pulverizing means (for example, ball mill, vibrating ball mill, sand mill, colloidal mill, jet mill and roller mill). In dispersing the antifoggant into solid fine particles, a dispersing aid may be used.

Although not necessary for practicing the present invention, it is sometimes advantageous to add mercury (II) salt to the emulsion layer as the antifoggant. The mercury(II) salt preferred to this purpose is mercury acetate or mercury bromide. The added amount of mercury for use in the present invention is preferably from $1\times10^{-9}$ to $1\times10^{-3}$ mol, more preferably from $1\times10^{-9}$ to $1\times10^{-4}$ mol, per mol of silver coated.

The silver halide grain for use in the present invention is formed by reacting an aqueous silver salt solution (for example, aqueous silver nitrate solution) and an aqueous halogen salt solution (for example, potassium bromide) in an aqueous colloidal solution in a reaction vessel. For performing this reaction, a single jet method where a protective colloid dispersion medium such as gelatin and an aqueous halogen salt solution are charged into a reaction vessel and an aqueous silver salt solution is added thereto while stirring over a certain period of time, and a double jet method where an aqueous gelatin solution is charged into a reaction vessel and an aqueous halogen salt solution and an aqueous silver salt solution each is added thereto over a certain period of time are known. In the present invention, the double jet method is preferred. By using the double jet method, silver halide grains having a narrow grain size distribution can be obtained.

Gelatin is advantageously used as a dispersion medium (binder or protective colloid) which can be used in the silver halide emulsion of the present invention, however, other hydrophilic colloids may also be used. Examples thereof include proteins such as gelatin derivatives, graft polymers of gelatin to other polymer, albumin and casein; cellulose derivatives such as hydroxyethyl cellulose, carboxymethyl cellulose and cellulose sulfate; saccharide derivatives such as sodium arginate and starch derivative; and various synthetic hydrophilic polymer materials such as homopolymers and copolymers of polyvinyl alcohol, polyvinyl alcohol partial acetal, poly-N-vinylpyrrolidone, poly-acrylic acid, polymethacrylic acid, polyacrylamide, polyvinyl imidazole or polyvinyl pyrazole.

As the gelatin, in addition to the general-purpose lime-processed gelatin, an acid-processed gelatin, an enzyme-processed gelatin described in *Bull. Soc. Photo. Japan*, Vol. 16, 30 (1966) or a gelatin hydrolysate may be used. Also, a gelatin a methionine moiety of which is subjected to oxidation processing with hydrogen peroxide may be preferably used.

The silver halide grain of the present invention is preferably desalted after the grain formation so as to adjust the pH, pAg or concentration of the dispersion medium such as gelatin.

With respect to the desalting method, the silver halide grain is preferably desalt-water washed by any conventionally known method and then dispersed in a newly prepared protective colloid. The water washing temperature may be selected according to the purpose, however, it is preferably selected within the range of from 5 to 50° C. The desalt-water washing method may be selected from noodle water washing, dialysis using a semipermeable membrane, centrifugation, coagulation precipitation, and ion exchange. In the case of coagulation precipitation, the method may be selected from a method of using a sulfate, a method of using an organic solvent, a method of using a water-soluble polymer and a method of using a gelatin derivative. The pH at the dispersion may also be selected according to the purpose, however, it is preferably selected within the range of from 2 to 10, more preferably from 4 to 7. The pAg at the dispersion may also be selected according to the purpose, however, it is preferably selected within the range of from 6 to 10, more preferably from 7 to 9.

It may be useful in some cases to add a chalcogenide compound described in U.S. Pat. No. 3,772,031 during the preparation of emulsion. Other than S, Se and Te, a cyanate, a thiocyanate, selenocyanate, a carbonate, a phosphate or an acetate may be allowed to be present.

The silver halide photographic emulsion of the present invention may contain a mercaptoheterocyclic compound or a tetrazaindene compound described in JP-A-7-225445 so as to prevent fogging during the production process, storing or photographic processing of the light-sensitive material, or to stabilize the photographic performance. In addition to these, a large number of compounds known as an antifoggant or stabilizer may be added, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercpatobenzimidazoles, mecaptothiadiazoles, aminotriazoles, benzotriazoles, nitrobenzotriazoles), azaindenes (e.g., triazaindenes, pentazaindenes), benzenethiosulfonic acids, benzenethiosulfinic acids and benzenesulfonic acid amides.

For the purpose of elevating the sensitivity or preventing fogging, the photothermographic material of the present invention may further contain an azolium salt or a benzoic acid. Examples of the azolium salt include the compounds represented by formula (XI) of JP-A-59-193447, the compounds described in JP-B-55-12581, and the compounds represented by formula (II) of JP-A-60-153039. The benzoic acids may be any benzoic acid derivative, however, preferred examples of the structure include the compounds described in U.S. Pat. Nos. 4,784,939 and 4,152,160, and JP-A-9-329865, JP-A-9-329864 and JP-A-9-281637. The azolium salt or benzoic acid may be added to any site of the light-sensitive material, however, is preferably added to a layer on the surface having a light-sensitive layer, more preferably to a layer containing a silver salt of an organic acid. The azolium salt or benzoic acid may be added at any process during the preparation of the coating solution. In the case of adding the azolium salt or benzoic acid to a silver halide emulsion layer, it may be added at any stage between the preparation of the silver halide emulsion and the preparation of the coating solution, however, is preferably added after the preparation of the silver halide emulsion but immediately before the coating. The azolium salt or benzoic acid may be added by any method such as powder, solution or fine particle dispersion and may also be added as a mixture solution with other additives such as sensitizing dye, reducing dye and toning agent. In the present invention, the amount of the azolium salt or benzoic acid may be any amount, however, it is preferably from $1\times10^{-6}$ to 2 mol, more preferably from $1\times10^{-3}$ to 0.5 mol, per mol of silver.

In the present invention, a mercapto compound, a disulfide compound or a thione compound may be contained so as to control the development by inhibiting or accelerating the development, improve the spectral sensitization efficiency or improve the storability before or after the development.

Examples of the mercapto compound, the disulfide compound and the thione compound include the compounds described in JP-A-10-62899 (paragraphs 0067 to 0069), the compounds represented by formula (I) of JP-A-10-186572 (and specific examples thereof described in paragraphs 0033 to 0052), and the compounds described in Unexamined European Patent Application No. 0803764A1 (page 20, lines 36 to 56). Among these, mercapto-substituted heteroaromatic compounds are preferred and examples thereof include 2-mercaptobenzimidazole, 2-mercapto-5-methylbenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiole, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiole, 2,3,5,6-tetrachloro-4-pyridinethiole, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole and 3-mercapto-4-phenyl-5-heptyl-1,2,4-triazole.

The amount of the mercapto compound added is preferably from 0.001 to 1.0 mol, more preferably from 0.01 to 0.3 mol, per mol of silver in the emulsion layer.

The light-sensitive silver halide for use in the present invention is preferably used in an amount of from 0.01 to 0.5 mol, more preferably from 0.02 to 0.3 mol, still more preferably from 0.02 to 0.20 mol, per mol of a silver salt of an organic acid. The mixing method or mixing conditions of light-sensitive silver halide and silver salt of an organic acid which are prepared individually are not particularly limited as long as the effect of the present invention can be obtained satisfactorily, however, a method of mixing the silver halide grains and the silver salt of an organic acid each after the completion of preparation, in high-speed rotated stirrer, a ball mill, a sand mill, a colloidal mill, a vibration mill or a homogenizer, or a method of preparing silver salt of an organic acid while mixing light-sensitive silver halide after the completion of preparation in any timing during the preparation of silver salt of an organic acid, may be used.

The time of adding the silver halide emulsion of the present invention to a coating solution for light-sensitive layer is from 180 minutes before the coating to immediately before the coating, preferably from 60 minutes to 10 seconds before the coating. However, the mixing method and the mixing conditions are not particularly limited as long as the effect of the present invention can be satisfactorily obtained. To speak specifically, a method of mixing the emulsion with the solution in a tank designed such that the average residence time calculated from the addition flow rate and the liquid transfer amount to the coater is set to a desired time, or a method using a static mixer described in N. Harnby, F. Edwards and A. W. Nienow (translated by Koji Takahashi), *Ekitai Kongo Gijutsu* (*Liquid Mixing Technique*), Chap. 8, Nikkan Kogyo Shinbun Sha (1989) may be used.

Oxidizing Agent

As the oxidizing agent for silver (in this case, indicates a micro-fine silver nucleus on the order of a few atoms, which works out to a physical development nucleus) aqueous hydrogen peroxide, mercury, bromosuccinimides, polyhalogenides described later, disulfide compounds, iodine, bromine and chlorine may be used. Furthermore, thiosulfonic acid compounds described in JP-A-2-105139 (the compounds represented by formulae (i), (ii) and (iii) and specific Compounds 1-1 to 1-33, 2-1 to 2-25 and 3-1 to 3-9) may also be preferably used.

The timing for adding the oxidizing agent may be freely selected between the grain formation and the completion of chemical sensitization, but is preferably added so that the oxidizing agent can be present during the grain formation and at the completion of grain formation. The amount of the oxidizing agent added may be freely selected according to the oxidizing power of the oxidizing agent, however, it is preferably from $10^{-6}$ to $10^{-1}$ mol per mol of silver.

Fine grains are unstable in the crystal habit and even if the silver halide fine grains are formed under the growing conditions usually of producing cubic crystals, the grains are rounded. The {100} face is known to be a system small in the inherent desensitization and having good color sensitization efficiency, therefore, the rounded grains cause serious reduction in the sensitivity. In order to prevent this, the formation of fine grains must be performed with various designs and it was found important for preparing the high-sensitivity ultrafine grains of the present invention that the grain has a {100} face ratio in excess of 50%.

For increasing the {100} face ratio, it was found effective to grow the grains at a low temperature while maintaining the shape by allowing a compound having a pKa of 6.0 or less (that is, mostly removed at the water washing or in the precipitation, desalting and water washing process at a pH of 5.0 or less) and liable to adsorb to the {100} face, such as benzimidazoles, or a mercapto-base compound, as a crystal habit regulating agent, to adsorb to the grain, and complete the addition of the dye before the initiation of chemical sensitization in the chemical sensitization process at a relatively high temperature. The amount of the adsorbing substance used is preferably from $10^{-5}$ to $10^{-1}$ mol per mol of silver halide.

The silver halide emulsion of the present invention can form a silver halide light-sensitive material by providing at least one light-sensitive layer comprising the emulsion on a support.

The effect of the present invention can be fully exerted in the case where the silver halide photographic light-sensitive material is a photothermographic material.

The photothermographic material has a light-sensitive layer comprising a binder matrix having dispersed therein the light-sensitive silver halide of the present invention, a reducible silver salt (e.g., a silver salt of an organic acid), a reducing agent for silver ion and if desired, a toning agent for controlling the silver tone. The photothermographic material is, after the image exposure, heated at a high temperature (for example, 80° C. or more) whereby an oxidation reduction reaction takes place between the silver halide or reducible silver salt (functions as an oxidizing agent) and a reducing agent, and a black silver image is formed.

The preferred photothermographic material is a photothermographic material comprising a support having thereon at least one light-sensitive layer containing a light-sensitive silver halide, a light-insensitive silver salt of an organic fatty acid, a reducing agent for silver ion and a binder, where the light-sensitive layer is formed by preparing the silver halide emulsion of the present invention independently of the silver salt of the organic fatty acid, mixing it with the silver salt of the organic fatty acid at the coating, and coating and drying the mixture.

The silver salt of the organic fatty acid which can be used in the present invention is a silver salt which is relatively stable to light but forms a silver image when heated at 80° C. or more in the presence of an exposed photocatalyst (e.g., a latent image of light-sensitive silver halide) and a reducing agent. The silver salt of the organic fatty acid is particularly preferably a silver salt of long chain aliphatic carboxylic acid (having from 10 to 30 carbon atoms, preferably from 15 to 28 carbon atoms) The silver salt of the organic fatty acid preferably constitutes approximately from 5 to 70% by weight of an image forming layer. Preferred examples of the silver salt of the aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

The shape of the silver salt of the organic fatty acid (hereinafter sometimes simply referred to as an "organic acid") which can be used in the present invention is not particularly limited, however, in the present invention, a scale-shaped silver salt of an organic acid is preferred. The scale-shaped silver salt of an organic acid can be defined as follows. A silver salt of an organic acid is observed through an electron microscope, the shape of the particle of the silver salt of the organic acid is approximated to a rectangular parallelopiped, and assuming that the sides of the rectangular parallelopiped are assumed to be a, b and c from the shorter side (c and b may be equal), x is calculated from the smaller numerical values a and b and obtained according to the following formula:

$$x=b/a$$

In this way, x values of about 200 particles are determined and assuming that the mean value is x (average) those satisfying the relationship of x (average)$\geqq$1.5 are defined as the scale form. The relationship is preferably 30$\geqq$x (average)$\geqq$1.5, more preferably 20$\geqq$x (average)$\geqq$2.0. Incidentally, in the case of acicular form, 1$\leqq$x (average) <1.5.

In the scale-shaped particle, a can be regarded as the thickness of a tabular grain where the plane having sides of b and c is the main plane. The average of a is preferably from 0.01 to 0.23 $\mu$m, more preferably from 0.1 to 0.20 $\mu$m. The average of c/b is preferably from 1 to 6, more preferably from 1.05 to 4, still more preferably from 1.1 to 3, particularly preferably from 1.1 to 2.

The particle size distribution of the silver salt of the organic acid is preferably monodisperse. The term "monodisperse" means that when the standard deviations of the short axis and the long axis are divided by the short axis and the long axis, respectively, the values in percentage obtained each is preferably 100% or less, more preferably 80% or less, still more preferably 50% or less. The form of the silver salt of an organic acid can be determined from an image by a transmission-type electron microscope. Alternatively, the monodispersity may be measured by a method of obtaining a standard derivation of a volume weighed mean diameter of silver salt of the organic acid. The standard deviation in percentage divided by the volume weighed mean diameter (coefficient of variation) is preferably 100% or less, more preferably 80% or less, still more preferably 50% or less. In the measurement, for example, a laser ray is irradiated on the silver salt of the organic acid dispersed in liquid, the autocorrelation function of the fluctuation of scattering light relative to the time change is obtained, and the grain size (volume weighed mean diameter) is determined therefrom.

The silver salt of an organic acid for use in the present invention is prepared by reacting an alkali metal salt (e.g., Na salt, K salt, Li salt) solution or suspension of the above-described organic acid with silver nitrate. The organic acid alkali metal salt for use in the present invention can be obtained by alkali-treating the above-described organic acid.

The silver salt of the organic acid for use in the present invention may be prepared batchwise or continuously in an appropriate vessel. The stirring in the reaction vessel may be performed by any appropriate stirring method according to the properties required for the particle. For the preparation of the silver salt of an organic acid, a method of gradually or rapidly adding an aqueous silver nitrate solution to a reaction vessel containing an organic acid alkali metal salt solution or suspension, a method of gradually or rapidly adding a previously prepared organic acid alkali metal salt solution or suspension to a reaction vessel containing an aqueous silver nitrate solution, or a method of simultaneously adding previously prepared aqueous silver nitrate solution and organic acid alkali metal salt solution or suspension to a reaction vessel may be preferably used.

The aqueous silver nitrate solution and the organic acid alkali metal salt solution or suspension each may be used in any concentration or may be added at any rate, so that the particle size of silver salt of the organic acid prepared can be controlled. The aqueous silver nitrate solution and the organic acid alkali metal salt solution or suspension each may be added at a constant rate, at an accelerated rate based on an arbitrary time function, or at a decelerated rate based on an arbitrary time function, and also may be added to the liquid surface or the inside of the reaction solution. In the case where previously prepared aqueous silver nitrate solution and organic acid alkali metal salt solution or suspension are simultaneously added to the reaction vessel, either the aqueous silver nitrate solution or the organic acid alkali metal salt solution or suspension may be early added, however, it is preferred to early add the aqueous silver nitrate solution. The degree of precedence is preferably from 0 to 50%, more preferably from 0 to 25%, of the total added amount. A method of adding them while controlling the pH or silver voltage of the reaction solution during the reaction, described in JP-A-9-127643, may also be preferably used.

The silver nitrate solution and the organic acid alkali metal salt solution or suspension to be added each may be controlled in the pH according to the properties required for the particle. For adjusting the pH, any acid or alkali may be added. According to the properties required for the particle, for example, in order to control the particle size of the silver salt of an organic acid prepared, not only the temperature in the reaction vessel may be freely selected but also the temperature of the silver nitrate solution or the organic acid alkali metal salt solution or suspension to be added may be freely adjusted. The organic acid alkali metal salt solution or suspension is preferably heated and kept at a temperature of 50° C. or more so as to ensure the flowability of the solution.

The silver salt of the organic acid for use in the present invention is preferably prepared in the presence of a tertiary alcohol. The tertiary alcohol for use in the present invention preferably an alcohol having a total carbon atom number of 15 or less, more preferably 10 or less. Preferred examples of the tertiary alcohol include t-butanol, however, the present invention is not limited thereto.

The tertiary alcohol for use in the present invention may be added at any timing during the preparation of the silver salt of the organic acid, but is preferably added at the preparation of the organic acid alkali metal to dissolve the organic acid alkali metal salt. The tertiary alcohol for use in the present invention may be used in any amount within the range of from 0.01 to 10 in terms of the weight ratio to $H_2O$ as the solvent at the preparation of silver salt of organic acid, however, is preferably used in an amount of from 0.03 to 1.

The scale-shaped silver salt of the organic acid which is preferably used in the present invention is preferably produced by a method such that at the time of reacting an aqueous solution containing a water-soluble silver salt with a tertiary alcohol aqueous solution containing the organic acid alkali metal salt in a reaction vessel (including the step of adding a tertiary alcohol aqueous solution containing the organic acid alkali metal salt to the solution within the reaction vessel), the temperature difference between the solution within the reaction vessel (preferably an aqueous solution containing a water-soluble silver salt, which is early charged; in the case of simultaneously adding the aqueous solution containing a water-soluble silver salt and the tertiary alcohol aqueous solution containing the organic acid alkali metal salt from the beginning without early adding the former solution as described later, water or a mixed solvent of water and tertiary alcohol may be previously charged; and even in the case of early adding the aqueous solution containing a water-soluble silver salt, water or a mixed solvent of water and tertiary alcohol may be previously charged) and the tertiary alcohol aqueous solution containing the organic acid alkali metal salt is controlled to be from 20 to 85° C.

By maintaining this temperature difference during the addition of the tertiary alcohol aqueous solution containing the organic acid alkali metal salt, the crystal form or the like of the silver salt of the organic acid can be advantageously controlled.

The water-soluble silver salt is preferably silver nitrate and the concentration of the water-soluble silver salt in the aqueous solution is preferably from 0.03 to 6.5 mol/l, more preferably from 0.1 to 5 mol/l. The pH of this aqueous solution is preferably from 2 to 6, more preferably from 3.5 to 6.

A tertiary alcohol having from 4 to 6 carbon atoms may also be contained. In this case, the volume thereof is 70% or less, preferably 50% or less, based on the entire volume of the aqueous solution containing a water-soluble silver salt. The temperature of the aqueous solution is preferably from 0 to 50° C., more preferably from 5 to 30° C. In the case of simultaneously adding the aqueous solution containing a water-soluble silver salt and the tertiary alcohol aqueous solution of organic acid alkali metal salt as described later, the temperature of the aqueous solution is most preferably from 5 to 15° C.

The alkali metal of the organic acid alkali metal salt is specifically Na or K. The organic acid alkali metal salt can be prepared by adding NaOH or KOH to an organic acid. At this time, it is preferred to allow unreacted organic acid to remain by setting the amount of the alkali to be equivalent or less to the organic acid. The amount of residual organic acid is from 3 to 50 mol %, preferably from 3 to 30 mol %, per 1 mol of the total organic acid. The amount of residual organic acid may also be adjusted by adding an alkali in an amount larger than necessary and thereafter adding an acid such as nitric acid or sulfuric acid to neutralize the excess alkali content.

According to the properties required for the silver salt of the organic acid, the pH can be controlled. For the control of pH, any acid or alkali may be used.

The aqueous solution containing a water-soluble silver salt, the tertiary alcohol aqueous solution of organic acid alkali metal salt and the solution within the reaction vessel, for use in the present invention, each may further contain, for example, a compound represented by formula (1) of JP-A-62-65035, a water-soluble group-containing N-heterocyclic compound described in JP-A-62-150240, an inorganic peroxide described in JP-A-50-101019, a sulfur compound descried in JP-A-51-78319, a disulfide compound described in JP-A-57-643, or a hydrogen peroxide.

The tertiary alcohol aqueous solution of organic acid alkali metal salt for use in the present invention is preferably a mixed solvent of a tertiary alcohol having from 4 to 6 carbon atoms and water so as to attain uniformity of the solution. If the carbon atom number exceeds the above-described range, compatibility with water is disadvantageously absent. Among tertiary alcohols having from 4 to 6 carbon atoms, tert-butanol having highest compatibility with water is most preferred. Alcohols other than the tertiary alcohol are not preferred because they have reducing property and cause problems in the formation of the silver salt of the organic acid. The amount of the tertiary alcohol used in combination in the tertiary alcohol aqueous solution of organic acid alkali metal salt is, in terms of the solvent volume, from 3 to 70%, preferably from 5 to 50%, based on the volume of water content in the tertiary alcohol aqueous solution.

The concentration of the organic acid alkali metal salt in the tertiary alcohol aqueous solution of organic acid alkali metal salt for use in the present invention is, in terms of the weight ratio, from 7 to 50 wt %, preferably from 7 to 45 wt %, more preferably from 10 to 40 wt %.

The temperature of the tertiary alcohol aqueous solution of organic acid alkali metal salt added to the reaction vessel for use in the present invention is preferably from 50 to 90° C., more preferably from 60 to 85° C., most preferably from 65 to 85° C., so as to maintain the temperature necessary for preventing crystallization or solidification of the organic acid alkali metal salt. Also, in order to perform the reaction at a constant temperature, the solution temperature is preferably controlled to fall within the above-described range.

The silver salt of the organic acid for use in the present invention is produced by i) a method of single adding the tertiary alcohol aqueous solution of organic acid alkali metal salt to an aqueous solution in a reaction vessel where the entire amount of the solution containing a water-soluble silver salt is already present or ii) a method having a time of simultaneously adding the aqueous solution of water-soluble silver salt and the tertiary alcohol aqueous solution of organic acid alkali metal salt to a reaction vessel (double addition method). In the present invention, the double addition method is preferred because the average particle size of the silver salt of the organic acid can be controlled to have a narrow distribution. In this case, it is preferred to simultaneously add 30 vol % or more, more preferably from 50 to 75 vol %, of the total amount added. In the case of early adding either solution, the solution of water-soluble silver salt is preferably added early.

In any case, the temperature of the solution in the reaction vessel (as described above, the aqueous solution of water-soluble silver salt early added or in the case of not early adding the aqueous solution of water-soluble silver salt, the solvent previously charged into the reaction vessel as described later) is preferably from 5 to 75° C., more preferably from 5 to 60° C., most preferably from 10 to 50° C. The solution is preferably controlled to a constant temperature selected from the above-described temperature range throughout the reaction process, however, it is also preferred to control the solution by some temperature patterns within the above-described temperature range.

In the present invention, the difference in the temperature between the tertiary alcohol aqueous solution of organic acid alkali metal salt and the solution within the reaction vessel is preferably from 20 to 85° C., more preferably from 30 to 80° C. In this case, the temperature of the tertiary alcohol aqueous solution of organic acid alkali metal salt is preferably higher.

By setting the temperature as such, the rate of the tertiary alcohol aqueous solution of organic acid alkali metal salt at a high temperature being abruptly cooled and precipitated as fine crystals and the rate of conversion into a silver salt of an organic acid as a result of reaction with the water-soluble silver salt can be advantageously controlled, so that the crystal form, the crystal size and the crystal size distribution of the silver salt of the organic acid can be advantageously controlled. At the same time, the performance as a (photo) thermographic material, particularly as a photothermographic material can be more improved.

Into the reaction vessel, a solvent may be previously charged. The solvent previously charged is preferably water but a mixed solvent of water and the above-described tertiary alcohol may be preferably used.

In the present invention, a dispersing aid which is soluble in an aqueous medium may be added to the tertiary alcohol aqueous solution of organic acid alkali metal, the aqueous solution of water-soluble silver salt or the reaction solution. The dispersing aid may be any as long as it can be disperse the silver salt of the organic acid formed. Specific examples thereof are the same as the dispersing aids described later for the silver salt of the organic acid.

In the preparation of the silver salt of the organic acid for use in the present invention, desalting/dehydration is preferably performed after the formation of silver salt. The method for performing the desalting/dehydration is not particularly limited and known and commonly used means may be used. For example, known filtration methods such as centrifugal filtration, suction filtration, ultrafiltration and flocculation washing by coagulation, and removal of supernatant by centrifugal precipitation may be preferably used. The desalting/dehydration may be performed either once or multiple times. The addition of water and the removal of water may be performed continuously or separately. The desalting/dehydration is performed such that the finally dehydrated water has a conductivity of preferably 300 $\mu$S/cm or less, more preferably 100 $\mu$S/cm or less, most preferably 60 $\mu$S/cm or less. The lower limit of the conductivity is not particularly limited but is usually about 5 $\mu$S/cm.

In order to attain good state on the coated surface of the photothermographic material, the silver salt of the organic acid is preferably formed into a fine water dispersion by a method where a water dispersion of the silver salt of the organic acid is obtained, converted into a high speed flow under a high pressure and thereafter redispersed by decreasing the pressure. The dispersion medium used here is preferably water alone but if it is 20 wt % or less, an organic solvent may be contained.

The silver salt of the organic acid may be finely dispersed by mechanically dispersing it using known pulverizing means (for example, high-speed mixer, homogenizer, high-speed impact mill, Banbury mixer, homomixer, kneader, ball mill, vibration ball mill, planetary mill, attritor, sand mill, beads mill, colloid mill, jet mill, roller mill, thoron mill and high-speed stone mill) in the presence of a dispersing aid.

If a light-sensitive silver salt is present together at the dispersion, the fog increases and the sensitivity seriously decreases. Accordingly, it is preferred not to contain a light-sensitive silver salt at the dispersion. In the present invention, the amount of the light-sensitive silver salt in a water dispersion where dispersed is 0.1 mol % or less per 1 mol of the silver salt of the organic acid in the solution and the light-sensitive silver salt is not positively added.

In the present invention, for obtaining a uniform solid dispersion of a silver salt of an organic acid having a high S/N and a small particle size and being free of coagulation, a great power is preferably given uniformly within the range of not causing breakage of particles of silver salt of an organic acid as an image formation medium or elevation of the temperature. To this purpose, a dispersion method of converting a water dispersion comprising the silver salt of an organic acid and a dispersant aqueous solution into a high-speed flow and then decreasing the pressure is preferably used.

The dispersing apparatus used in practicing the above-described re-dispersion method and techniques thereon for use in the present invention are described in detail, for example, in Toshio Kajiuchi and Hiromoto Usui, *Bunsan-Kei Rheology to Bunsan-Ka Giiutsu* (*Dispersion System Rheology and Dispersion Technology*), pp. 357–403, Shinzan-Sha Shuppan K.K. (1991), Kagaku Kogaku Kai Tokai Shibu (compiler), *Kagaku Kogaku no Shimpo Dai* 24 *Shu* (*Process of Chemical Engineering, No.* 24), pp. 184–185, Maki Shoten (1990), JP-A-59-49832, U.S. Pat. No. 4,533,254, JP-A-8-137044, JP-A-8-238848, JP-A-2-261525 and JP-A-1-94933. In the present invention, the re-dispersion is performed by a method where a water dispersion containing at least the silver salt of an organic acid is transferred into a pipeline by pressurizing it using a high-pressure pump or the like and passed through a thin slit provided within the pipeline, and then the pressure of the dispersion solution is abruptly reduced, thereby attaining fine dispersion.

In the high-pressure homogenizer for use in the present invention, it is considered that (a) the "shearing force" generated upon passing of the dispersoid through a narrow opening (approximately from 75 to 350 $\mu$m) at a high pressure and a high speed and (b) the impact force generated at the liquid-liquid collision in a narrow space under a high pressure or at the collision against the wall surface are generally not changed but the cavitation force due to the pressure reduction occurred thereafter is more intensified and thereby uniform and highly efficient dispersion can be attained. As the dispersing apparatus of this type, Gaulin homogenizer is long known. However, in this homogenizer, the dispersion solution transferred under a high pressure is converted into a high-speed flow in the narrow opening on the cylindrical face, the force generated there enforces the solution to collide against the peripheral wall surface, and the impact force generated allows the emulsification and dispersion to proceed. Examples of the liquid-liquid collision-type apparatus include the Y-type chamber of microfluidizer and a spherical chamber using a spherical check valve described in JP-A-8-103642, and examples of the liquid-wall surface collision-type apparatus include the Z-type chamber of microfluidizer. The pressure used is generally from 100 to 600 kg/cm$^2$ and the flow rate is from a few m to 30 m/sec. Some apparatuses are designed to increase the collision frequency by forming the high-speed flow part in the serrated shape and thereby increase the dispersion efficiency. Representative examples of the apparatus of this type include Gaulin homogenizer, the microfluidizer manufactured by Microfluidex International Corporation, the microfluidizer manufactured by Mizuho Kogyo K.K., and the nanomizer manufactured by Tokushu Kika Kogyo K.K. The apparatuses are also described in JP-A-8-238848, JP-A-8-103642 and U.S. Pat. No. 4,533,254.

The silver salt of the organic acid for use in the present invention may be dispersed in a desired particle size by controlling the flow rate, the pressure difference at the decrease of pressure, and the treatment frequency, however, in view of the photographic properties and the particle size, it is preferred that the flow rate is from 200 to 600 m/sec and the pressure difference at the decrease of pressure is from 900 to 3,000 kg/cm$^2$, more preferably that the flow rate is from 300 to 600 m/sec and the pressure difference at the decrease of pressure is from 1,500 to 3,000 kg/cm$^2$. The dispersion treatment frequency may be selected according to the necessity. The dispersion frequency is usually from 1 to 10 times but in view of the productivity, it is preferably from 1 to 3 times. If the water dispersion is elevated to a high temperature under a high pressure, adverse effects are caused in view of the dispersibility and the photographic properties. For example, if the temperature exceeds 90° C., a large particle size is liable to result and the fog readily increases. Therefore, in the present invention, it is preferred that a cooling unit is contained in the process before the conversion into a high-pressure and high-speed flow, in the process after the decrease of pressure or in both processes and the water dispersion is maintained by the cooling process at a temperature of from 5 to 90° C., more preferably from 5 to 80° C., still more preferably from 5 to 65° C. In the case of dispersion under high pressure of from 1,500 to 3,000 kg/cm$^2$, the cooling process provided is particularly effective. The cooling unit may be appropriately selected according to the required heat exchanging amount from those using a static mixer for the double or triple pipe, a tubular heat exchanger and a coiled heat exchanger. Furthermore, by taking account of the pressure used, those having suitable pipe size, wall thickness or constructive material may be selected so as to increase the efficiency of heat exchanging. In view of the heat exchanging amount, the refrigerant used in the cooler is well water at 20° C. or chilled water of from 5 to 10° C. treated by a refrigerator. Also, if desired, a refrigerant such as ethylene glycol/water at −30° C. may be used.

In forming the silver salt of the organic acid into solid fine particles using a dispersant, a synthetic anion such as polyacrylic acid, a copolymer of acrylic acid, a maleic acid copolymer, a maleic acid monoester copolymer and an acryloylmethylpropanesulfonic acid copolymer, a semisynthetic anion polymer such as carboxymethyl starch and carboxymethyl cellulose, an anionic polymer such as alginic acid and pectic acid, an anionic surface active agent described in JP-A-52-92716 and W088/04794, a compound described in JP-A-9-179243, a known anionic, nonionic or cationic surface active agent, a known polymer such as polyvinyl alcohol, polyvinyl pyrrolidone, carboxymethyl cellulose, hydroxypropyl cellulose and hydroxypropylmethyl cellulose, or a natural polymer compound such as gelatin, may be appropriately selected and used.

According to a general method, the dispersing aid is mixed with the powder of the silver salt of the organic acid before the dispersion or with the silver salt of the organic acid in the wet cake state, and fed as a slurry to a disperser. The dispersing aid previously mixed with the silver salt of the organic acid may be heat treated or treated with a solvent to form a powder of a silver salt of an organic acid or wet cake. Before, after or during the dispersion, the pH may be controlled using an appropriate pH adjusting agent.

Other than the mechanical dispersion, fine particles of silver salt of an organic acid may also be formed by controlling the pH to prepare a crude dispersion in a solvent and thereafter varying the pH in the presence of a dispersing aid to form fine particles. At this time, the solvent used in the crude dispersion may be the organic acid as solvent and the organic solvent is usually removed after the completion of fine particle formation.

The dispersion prepared may be stored while stirring so as to prevent precipitation of fine particles during the storage or may be stored in the high-viscosity state using a hydrophilic colloid (for example, in the jelly state using gelatin). For the purpose of preventing proliferation of miscellaneous bacteria during the storage, an antiseptic may be added.

The silver salt of an organic acid prepared by the preparation method of silver salt of organic acid of the present invention is preferably dispersed in a water solvent and then mixed with an aqueous solution of light-sensitive silver salt and fed as a coating solution for the light-sensitive image-forming medium.

In advance of the dispersion operation, the raw material solution is crudely dispersed (preliminary dispersion). As the means for use in the crude dispersion, known dispersing means (for example, high-speed mixer, homogenizer, high-speed impact mill, Banbury mixer, homomixer, kneader, ball mill, vibration ball mill, planetary ball mill, attritor, sand mill, beads mill, colloid mill, jet mill, roller mill, thoron mill and high-speed stone mill) may be used. Other than the mechanical dispersion, it is also possible to prepare a crude dispersion in a solvent by controlling the pH and form fine particles by changing the pH in the presence of a dispersion aid. At this time, the solvent used for the crude dispersion may be an organic solvent and the organic solvent is usually removed after the completion of formation of fine particles.

The aqueous solution of light-sensitive silver salt is finely dispersed and then mixed to produce a coating solution for the light-sensitive image-forming medium. When a photothermographic material is manufactured using such a coating solution, the photothermographic material obtained can be low in the haze and fog and favored with high sensitivity. On the other hand, if a light-sensitive silver salt is present together at the dispersion by converting the water dispersion into a high-pressure and high-speed flow, the fog increases and the sensitivity seriously decreases. Furthermore, if the dispersion medium used is not water but an organic solvent, high haze, increase in the fog and reduction in the sensitivity are liable to result. If a conversion method of converting a part of the silver salt of an organic acid in the dispersion solution into light-sensitive silver salt is used in place of the method of mixing the aqueous solution of light-sensitive silver salt, the sensitivity decreases.

The above-described water dispersion which is dispersed by converting it into a high-pressure and high-speed flow contains substantially no light-sensitive silver salt. The content of the light-sensitive silver salt is 0.1 mol % or less based on the light-insensitive silver salt of an organic acid and the light-sensitive silver salt is not positively added.

The particle size (volume weighed mean diameter) of the solid fine particle dispersion of a silver salt of an organic acid for use in the present invention can be obtained, for example, by irradiating a laser ray on the solid fine particle dispersion dispersed in liquid, obtaining an autocorrelation function of the fluctuation of scattering light relative to the time change, and determining the grain size (volume weighed mean diameter) therefrom. The solid fine particle dispersion preferably has an average particle size of from 0.05 to 10.0 $\mu$m, more preferably from 0.1 to 5.0 $\mu$m, still more preferably from 0.1 to 2.0 $\mu$m.

The solid fine particle dispersion of silver salt of organic acid for use in the present invention comprises at least a silver salt of an organic acid and water. The ratio between the silver salt of an organic acid and water is not particularly limited but the occupation ratio of the silver salt of an organic acid in the entire dispersion is preferably from 5 to 50 wt %, more preferably from 10 to 30 wt %. The dispersion aid described above is preferably used but is preferably used in a minimum amount within the range suitable for attaining a minimum particle size, more specifically, in an amount of from 1 to 30 wt %, more preferably from 3 to 15 wt %, based on the silver salt of an organic acid.

In the present invention, a light-sensitive material can be produced by mixing the water dispersion of the silver salt of an organic acid and the light-sensitive silver salt water dispersion and the mixing ratio of the silver salt of an organic acid to the light-sensitive silver salt can be selected according to the purpose, however, the ratio of the light-sensitive silver salt to the silver salt of an organic acid is preferably from 1 to 30 mol %, more preferably from 3 to 20 mol %, still more preferably from 5 to 15 mol %. A method of mixing two or more water dispersions of silver salt of an organic acid and two or more light-sensitive silver salt water dispersions at the mixing is preferably used for controlling the photographic properties.

The silver salt of an organic acid for use in the present invention may be used in any desired amount, however, the amount in terms of silver is preferably from 0.1 to 5 g/m$^2$, more preferably from 1 to 3 g/m$^2$.

Reducing Agent

The photothermographic material of the present invention preferably contains a reducing agent for a silver salt of an organic acid. The reducing agent for a silver salt of an organic acid may be any material capable of reducing silver ion into metal silver, preferably an organic material. Conventional photographic developers such as phenidone, hydroquinone and catechol are useful, however, a hindered phenol reducing agent is preferred. The reducing agent is preferably contained in an amount of from 5 to 50 mol %, more preferably from 10 to 40 mol %, per 1 mol of silver on the surface having an image forming layer. The layer where reducing agent is added may be any layer on the surface having an image forming layer. In the case of adding the reducing agent to a layer other than the image forming layer, the ratio of the reducing agent is preferably used in a little large amount of from about 10 to 50% per 1 mol of silver. The reducing agent may be a so-called precursor which is derived to exhibit an effective function only at the development.

For the photothermographic material, reducing agents over a wide range are disclosed in JP-A-46-6074, JP-A-47-1238, JP-A-47-33621, JP-A-49-46427, JP-A-49-115540, JP-A-50-14334, JP-A-50-36110, JP-A-50-14771, JP-A-51-32632, JP-A-61-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686 and 5,464,738, German Patent 2,321,328 and European Patent 692,732. Examples thereof include amidoxime such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl)propionyl-β-phenylhydrazine with an ascorbic acid; combinations of polyhydroxybenzene with hydroxylamine, reductone and/or hydrazine, such as a combination of hydroquinone with bis(ethoxyethyl) hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol, such as a combination of phenothiazine with 2,6-dichloro-4-benzenesulfonamidophenol; α-cyano-phenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones, such as benzyl and biacetyl; 3-pyrazolidone and a certain kind of indane-1,3-dione; and chromanols such as tocopherol. Among these, preferred reducing agents are bisphenol and chromanol.

In the present invention, the reducing agent may be used by any method such as solution, powder or solid fine particle dispersion. The formation of a solid fine particle dispersion may be performed using a known pulverizing method (for example, ball mill, vibration ball mill, sand mill, colloid mill, jet mill and roller mill). In the formation of a solid fine particle dispersion, a dispersing aid may be used.

The photothermographic material of the present invention may have a high optical density by containing an additive known as a "color toning agent" of improving the image. The color toning agent may be advantageous in forming a black silver image. The color toning agent is preferably contained on the surface having a light-sensitive layer, in an amount of from 0.1 to 50 mol %, more preferably from 0.5 to 20 mol %, per mol of silver. The color toning agent may be a so-called precursor which is derived to exhibit the effective function only at the development.

For the photothermographic material, color toning agents over a wide range are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-1478, JP-A-52-99813, JP-A-53-1020, JP-A-53-76020, JP-A-54-156524, JP-A-54-156525, JP-A-61-183642, JP-A-4-56848, JP-B-49-10727, JP-A-54-20333, U.S. Pat. Nos. 3,080,254, 3,446,648, 3,782,941, 4,123,282 and 4,510,236, British Patent 1,380,795 and Belgian Patent 841,910. Examples of the color toning agent include phthalimide and N-hydroxyphthalimide; cyclic imides such as succinimide, pyrazolin-5-one, quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and a certain kind of light discoloring agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)(benzothiazole); 3-ethyl-5-[(3-ethyl-2-benzothiazolinylidene)-1-methylethylidene]-2-thio-2,4-oxazolidinedione; phthalazinone, phthalazinone derivatives and metal salts, and derivatives thereof (e g., 4-(1-naphthyl)phthalazinone, 6-chlorophthalazinone, 5,7-dimethoxyphthalazinone, 2,3-dihydro-1,4-phthalazinedione); combinations of phthalazinone with a phthalic acid derivative (e.g., phthalic acid, 4-methylphthalic acid, 4-nitrophthalic acid, tetrachlorophthalic anhydride); phthalazine, phthalazine derivatives and metal salts, and derivatives thereof (e.g., 4-(1-naphthyl) phthalazine, 6-chlorophthalazine, 5,7-dimethoxyphthalazine, 2,3-dihydrophthalazine); combinations of phthalazine with a phthalic acid derivative (e.g., phthalic acid, 4-methylphthalic acid, 4-nitrophthalic acid, tetrachlorophthalic anhydride); quinazolinedione, benzoxazine and naphthoxazine derivatives; rhodium complexes which function not only as a color tone controlling agent but also as a source of halide ion for producing silver halide at the site, such as ammonium hexachlororhodate(III), rhodium bromide, rhodium nitrate and potassium hexachlororhodate(III); inorganic peroxides and persulfates, such as ammonium peroxydisulfide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines, such as 2,4-dihydroxypyrimidine and 2-hydroxy-4-amino-pyrimidine; azauracil; and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

In the present invention, the color toning agent may be used by any method such as solution, powder or solid fine particle dispersion. The formation of a solid fine particle dispersion may be performed using a known pulverizing method (for example, ball mill, vibration ball mill, sand mill, colloid mill, jet mill and roller mill). In the formation of a solid fine particle dispersion, a dispersing aid may be used.

The effect of the present invention can be brought out when the layer containing the silver salt of an organic acid is formed by coating and drying a coating solution comprising water in an amount of 30 wt % or more based on the solvent and further when the binder in the layer containing the silver salt of an organic acid is soluble or dispersible in an aqueous solvent (water solvent) and comprises a polymer latex having an equilibrium moisture content particularly at 25° C. and 60% RH, of 2 wt % or less. The coating solution is most preferably prepared to have an ion conductivity of 2.5 mS/cm or less. This coating solution may be prepared by purifying the polymer synthesized using a membrane having a separating function.

The aqueous solvent where the above-described polymer is soluble or dispersible is water or a solvent obtained by mixing 70 wt % or less of a water-miscible organic solvent with water. Examples of the water-miscible organic solvent include alcohol-base solvents such as methyl alcohol, ethyl alcohol and propyl alcohol, cellosolve-base solvents such as methyl cellosolve, ethyl cellosolve and butyl cellosolve, ethyl acetate, and dimethylformamide.

The term "aqueous solvent" is used here even for a system where the polymer is not thermodynamically dissolved but is present in the so-called dispersed state.

The "equilibrium moisture content at 25° C. and 60% RH" can be expressed as follows using the weight W1 of a polymer in the humidity equilibration in an atmosphere of 25° C. and 60% RH and the weight W0 of a polymer in the bone dry state at 25° C.:

$$\text{Equilibrium moisture content at 25° C. and 60\% RH}=[(W1-W0)/W0]\times 100\ (\text{wt \%})$$

With respect to the definition and the measuring method of moisture content, for example, *Bunshi Kogaku Koza* 14, *Kobunshi Zairyo Shiken Hou* (*Lecture* 14 *of Polymer Engineering, Polymer Material Testing Method*), compiled by Kobunshi Gakkai, Chijin Shokan.

The binder polymer for use in the present invention preferably has an equilibrium moisture content at 25° C. and 60% RH, of 2 wt % or less, more preferably from 0.01 to 1.5 wt %, still more preferably from 0.02 to 1 wt %.

In the present invention, a polymer dispersible in an aqueous solvent is particularly preferred.

Examples of the dispersed state include a latex where solid polymer fine particles are dispersed, and those where the polymer molecules are dispersed in the molecular state or by forming a micelle.

In the present invention, hydrophobic polymers such as acrylic resin, polyester resin, rubber-base resin (e.g., SBR resin), polyurethane resin, vinyl chloride resin, vinyl acetate resin, vinylidene chloride resin and polyolefin resin can preferably be used. The polymer may be a linear polymer, a branched polymer or a crosslinked polymer. Also, the polymer may be a homopolymer obtained by polymerizing a single monomer or a copolymer obtained by polymerizing two or more kinds of monomers. Furthermore, the copolymer may be a random copolymer or a block copolymer. The molecular weight of the polymer is in terms of the number average molecular weight from 5,000 to 1,000,000, preferably from 10,000 to 200,000. If the molecular weight is excessively small, the emulsion layer is insufficient in the mechanical strength, whereas if it is excessively large, the film forming property is disadvantageously poor.

The term "aqueous solvent" as used herein means a dispersion medium where 30 wt % or more of the composition is water. The dispersed state may be emulsion dispersion, micelle dispersion or dispersion where a polymer having a hydrophilic site in the molecule is dispersed in the molecular state. Among these, latex is particularly preferred.

Specific examples of preferred polymers include the followings. In the following, the polymers are expressed using respective starting materials, the numerical value in the parenthesis is in the unit of wt %, and the molecular weight is a number average molecular weight.

P-1: latex of -MMA(70)-EA(27)-MAA(3)-(molecular weight: 37,000)

P-2: latex of -MMA(70)-2EHA(20)-St(5)-AA(5)-(molecular weight: 40,000)

P-3: latex of -St(50)-Bu(47)-MAA(3)-(molecular weight: 45,000)

P-4: latex of -St(68)-Bu(29)-AA(3)-(molecular weight: 60,000)

P-5: latex of -St(70)-Bu(27)-IA(3)-(molecular weight: 120,000)

P-6: latex of -St(75)-Bu(24)-AA(1)-(molecular weight: 108,000)

P-7: latex of -St(60)-Bu(35)-DVB(3)-MAA(2)-(molecular weight: 150,000)

P-8: latex of -St(70)-Bu(25)-DVB(2)-AA(3)-(molecular weight: 280,000)

P-9: latex of -VC(50)-MMA(20)-EA(20)-AN(5)-AA(5)-(molecular weight: 80,000)

P-10: latex of -VDC(85)-MMA(5)-EA(5)-MAA(5)-(molecular weight: 67,000)

P-11: latex of -Et(90)-MAA(10)-(molecular weight: 12,000)

P-12: latex of -St(70)-2EHA(27)-AA(3) (molecular weight: 130,000)

P-13: latex of -MMA(63)-EA(35)-AA(2) (molecular weight: 33,000)

In the above-described structures, the abbreviations indicate the following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

These polymers are also commercially available and the following polymers may be used. Examples of the acrylic resin include Sebian A-4635, 46583, 4601 (all produced by Daicell Chemical Industry K.K.), Nipol Lx811, 814, 821, 820 and 857 (all produced by Nippon Zeon K.K.); examples of the polyester resin include FINETEX ES650, 611, 675, 850 (all produced by Dai-Nippon Ink & Chemicals, Inc.), WD-size and WMS (all produced by Eastman Chemical Products, Inc.); examples of the polyurethane resin include HYDRAN AP10, 20, 30, 40 (all produced by Dai-Nippon Ink & Chemicals, Inc.); examples of the rubber-base resin include LACSTAR 7310K, 3307B, 4700H, 7132C (all produced by Dai-Nippon Ink & Chemicals, Inc.), Nipol Lx416, 410, 438C and 2507 (all produced by Nippon Zeon K.K.); examples of the vinyl chloride resin include G351 and G576 (both produced by Nippon Zeon K.K.); examples of the vinylidene chloride resin include L502 and L513 (both produced by Asahi Chemical Industry Co., Ltd.); and examples of the olefin resin include Chemipearl S120 and SA100 (produced by Mitsui Petrochemical Industries, Ltd.).

These polymers each may be used solely as a latex or two or more thereof may be blended, if desired.

As the polymer latex for use in the present invention, a latex of styrene-butadiene copolymer is particularly preferred. In the styrene-butadiene copolymer, the weight ratio between the styrene monomer unit and the butadiene monomer unit is preferably from 40:60 to 95:5. Furthermore, the ratio of the styrene monomer unit and the butadiene monomer unit occupying the copolymer is preferably from 60 to 99 wt %. The preferred molecular weight range is the same as above.

Examples of preferred latexes of styrene-butadiene copolymer include P-3 to P-8 described above and commercially available products LACSTAR-3307B, 7132C and Nipol Lx416.

The light-sensitive layer of the photothermographic material of the present invention may contain, if desired, a hydrophilic polymer such as gelatin, polyvinyl alcohol, methyl cellulose and hydroxypropyl cellulose. The amount of the hydrophilic polymer added is preferably 30 wt % or less, more preferably 20 wt % or less, based on the entire binder.

The light-sensitive layer for use in the present invention is preferably formed using a polymer latex together and the amount of the binder in the light-sensitive layer is preferably, in terms of the weight ratio of entire binder/silver salt of an organic acid, from 1/10 to 10/1, more preferably from 1/5 to 4/1.

In the light-sensitive layer, the weight ratio of entire binder/silver halide is preferably from 400 to 5, more preferably from 200 to 10.

The total binder amount in the light-sensitive layer for use in the present invention is preferably from 0.2 to 30 g/m$^2$, more preferably from 1 to 15 g/m$^2$. The light-sensitive layer for use in the present invention may contain a crosslinking agent for forming crosslinking or a surface active agent for improving the coatability.

The solvent used in the coating solution for the light-sensitive layer of the photothermographic material of the present invention (for the sake of simplicity, the solvent and the dispersion medium are collectively called a solvent here) is preferably an aqueous solvent containing 30 wt % or more of water. As the component other than water, an optional water-miscible organic solvent such as methyl alcohol, ethyl alcohol, isopropyl alcohol, methyl cellosolve, ethyl cellosolve, dimethylformamide and ethyl acetate, may be used. The solvent of the coating solution preferably has a water content of 50 wt % or more, more preferably 70 wt % or more. Examples of preferred solvent compositions include water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5.

The light-sensitive layer for use in the present invention may contain a plasticizer or a lubricant such as a polyhydric alcohol (for example, glycerin and diol described in U.S. Pat. No. 2,960,404), a fatty acid or ester described in U.S. Pat. Nos. 2,588,765 and 3,121,060), or a silicone resin described in British Patent 955,061.

In the present invention, an ultrahigh contrast agent for forming an ultrahigh contrast image may be used and examples thereof include hydrazine derivatives described in U.S. Pat. Nos. 5,464,738, 5,496,695, 6,512,411 and 5,536,622, and JP-A-10-10672, JP-A-10-62898, JP-A-10-31282, JP-A-9-319048, JP-A-9-304870 and JP-A-9-304872, compounds having a quaternary nitrogen atom described in JP-A-9-274274, and acrylonitrile compounds described in U.S. Pat. No. 5,545,515. Specific examples of the compound include Compounds 1 to 10 of U.S. Pat. No. 5,464,738, H-1 to H-28 of U.S. Pat. No. 5,496,695, I-1 to I-86 of JP-A-10-10672, H-1 to H-62 of JP-A-10-62898, I-1 to I-21, of JP-A-10-31282, 1 to 50 of JP-A-9-304870, 1 to 40 of JP-A-9-304872, P-1 to P-26 and T-1 to T-18 of JP-A-9-274274, and CN-1 to CN-13 of U.S. Pat. No. 5,545,515.

For forming an ultrahigh contrast image, a contrast promoting agent may be used in the present invention in combination with the above-described ultrahigh contrast agent. Examples thereof include amine compounds, specifically AM-1 to AM-5, described in U.S. Pat. No. 5,545,505; hydroxamic acids, specifically, HA-1 to HA-11, described in U.S. Pat. No. 5,545,507; acrylonitriles, specifically CN-1 to CN-13, described in U.S. Pat. No. 5,545,507; hydrazine compounds, specifically CA-1 to CA-6, described in U.S. Pat. No. 5,558,983; and onium salts, specifically A-1 to A-42, B-1 to B-27 and C-1 to C-14, described in JP-A-9-297368.

The synthesis methods, adding methods and added amount of the ultrahigh contrast agent and the contrast promoting agent are described in respective patents.

The image-forming material for use in the present invention may comprise a surface protective layer so as to prevent adhesion of the image-forming layer.

The binder in the light-insensitive layer (for example, a surface protective layer and an interlayer) for use in the present invention may be any polymer and examples thereof include those described as the binder which can be used in the emulsion. The light-insensitive layer preferably contains from 100 mg/m$^2$ to 5 g/m$^2$ of a polymer having a carboxylic acid residue. Examples of the polymer having a carboxyl acid residue include natural polymers (e.g., gelatin, alginic acid), modified natural polymers (e.g., carboxymethyl cellulose, phthalized gelatin) and synthetic polymers (e.g., polymethacrylate, polyacrylate, polyalkyl methacrylate/acrylate copolymer, polystyrene/polymethacrylate copolymer). The content of the carboxylic acid residue in the polymer is preferably from $1\times10^{-2}$ to 1.4 mol per 100 g of polymer. The carboxylic acid residue may also form a salt with an alkali metal ion, an alkaline earth metal ion or an organic cation.

In the surface protective layer, polyvinyl alcohol (PVA) is preferably used as the binder. Examples thereof include completely saponified PVA-105 [polyvinyl alcohol (PVA) content: 94.0 wt % or more, degree of saponification: 98.5±0.5 mol %, sodium acetate content: 1.5 wt % or less, volatile matter: 5.0 wt % or less, viscosity (4 wt %, 20° C.): 5.6±0.4 CPS], partially saponified PVA-205 [PVA content: 94.0 wt %, degree of saponification: 88.0±1.5 mol %, sodium acetate content: 1.0 wt %, volatile matter: 5.0 wt %, viscosity (4 wt %, 20° C.): 5.0±0.4 CPS], and modified polyvinyl alcohols MP-102, MP-202, MP-203, R-1130 and R-2105 (trade names, produced by Kuraray Co., Ltd.).

The amount of polyvinyl alcohol coated (per 1 m$^2$ of support) in the surface protective layer (per one layer) is preferably from 0.3 to 4.0 g/m$^2$, more preferably from 0.3 to 2.0 g/m$^2$.

As the surface protective layer for use in the present invention, any adhesion preventing material may be used. Examples of the adhesion preventing material include wax, silica particle, styrene-containing elastomeric block copolymers (e.g., styrene-butadiene-styrene, styrene-isoprene-styrene), cellulose acetate, cellulose acetate butyrate, cellulose propionate, and mixtures thereof. Furthermore, the surface protective layer may contain a crosslinking agent for forming crosslinking, or a surface active agent for improving the coatability.

The light-sensitive layer or surface protective layer for use in the present invention may be used in photographic elements containing a light-absorbing substance and a filter dye described in U.S. Pat. Nos. 3,253,921, 2,274,782, 2,527,583 and 2,956,879. Furthermore, the layer may be mordanted with a dye as described, for example, in U.S. Pat. No. 3,282,699. The filter dye used is preferably used in an amount of giving an absorbency at the exposure wavelength of from 0.1 to 3.0, more preferably from 0.2 to 1.5.

The light-sensitive layer for use in the present invention may contain a delustering agent such as starch, titanium dioxide, zinc oxide, silica and a polymer bead containing a bead of the kind described in U.S. Pat. Nos. 2,992,101 and 2,701,245.

The temperature at the preparation of the coating solution for the light-sensitive layer for use in the present invention is preferably from 30 to 65° C., more preferably from 35 to less than 60° C. The coating solution for the light-sensitive layer immediately after the addition of polymer latex is preferably maintained at a temperature of from 30 to 65° C. In the coating solution, a reducing agent and a silver salt of an organic acid are preferably mixed before adding the latex.

The coating solution for the light-sensitive layer for use in the present invention is preferably a so-called thixotropy fluid. The "thixotropy" means a property such that the viscosity decreases accompanying the increase of the shear rate. In the present invention, the viscosity may be measured using any apparatus but is preferably measured at 25° C. using RFS Fluid Spectrometer manufactured by Rheometrics Far East K.K. The coating solution for the light-sensitive layer in the present invention preferably has a viscosity at a shear rate of 0.1S-1, of from 400 to 100,000 mPa·s, more preferably from 500 to 20,000 mPa·s. At a shear rate of 1000S-1, the viscosity is preferably from 1 to 200 mPa·s, more preferably from 5 to 80 mPa·s.

Various kinds of systems are known to reveal the thixotropy and described in *Koza.Rheology* (*Lecture-Rheology*), compiled Kobunshi Kanko Kai, Muroi and Morino, *Kobunshi Latex* (*Polymer Latex*), issued by Kobunshi Kanko Kai. For allowing a fluid to reveal thixotropy, many solid fine particles must be contained. For intensifying the thixotropy, it is effective to incorporate a thick linear polymer, increase the aspect ratio by the anisotropic form of solid fine particle contained, or use an alkali thickener or a surface active agent.

The photothermographic material of the present invention comprises one or more layers on a support. In the case of a one-layer structure, the layer comprises a silver salt of an organic acid, a silver halide, a developer and a binder and additionally contains desired materials such as a color toning agent, a coating aid and other auxiliary agents. In the case of a two-layer structure, the first emulsion layer (usually a layer adjacent to the substrate) contains a silver salt of an organic acid and a silver halide and the second layer or both layers must contain other several components. A two-layer structure comprising a single emulsion layer containing all components and a protective topcoat may also be used. In the structure of a multi-color light-sensitive heat-developable photographic material, the above-described two-layer combination may be used for respective colors or all components may be contained in a single layer as described in U.S. Pat. No. 4,708,928. In the case of a multi-dye multi-color light-sensitive heat-developable photographic material, respective emulsion layers are generally divided from each other and held by providing a functional or non-functional barrier layer between respective light-sensitive layers as described in U.S. Pat. No. 4,460,681.

In the present invention, the light-sensitive layer may contain a dye or pigment of various types from the standpoint of improving the tone or preventing the irradiation. The dyes and pigments are described in detail in WO98/36322. Examples of the dye and pigment preferably used in the light-sensitive layer of the present invention include anthraquinone dyes, azomethine dyes, indoaniline dyes, azo dyes, anthraquinone-base indanthrone pigments (e.g., C.I. Pigment Blue 60), phthalocyanine pigments (e.g., copper phthalocyanine such as C.I. Pigment Blue 15, metal-free phthalocyanine such as C.I. Pigment Blue 16), dyed lake pigment-base triarylcarbonyl pigments, indigo and inorganic pigments (e.g., ultramarine, cobalt blue). The dye or pigment may be added by any method, for example, as a solution, an emulsified product or a solid fine particle dispersion or in the state of being mordanted by a polymer mordant. The amount of the dye or pigment is selected according to the objective amount absorbed, however, in general, it is preferably from 1 $\mu$g to 1 g per 1 $m^2$.

In the present invention, an antihalation layer may be provided farther from the light source with respect to the light-sensitive layer. The antihalation layer preferably has a maximum absorption of from 0.3 to 2 in the desired wavelength, more preferably has a maximum absorption of from 0.5 to 2 in the exposure wavelength and an absorption of from 0.001 to less than 0.5 in the visible region after the processing, and still more preferably has an optical density of from 0.001 to less than 0.3.

In the present invention, when an antihalation dye is used, the dye may be any compound as long as it has absorption in the desired wavelength region and sufficiently small absorption in the visible region after the processing and can give a preferred absorbency spectrum to the above-described antihalation layer. Examples of the antihalation dye include those described in the following patent publications, however, the present invention is by no means limited thereto. Examples of a single dye include the compounds described in JP-A-59-56458, JP-A-2-216140, JP-A-7-13295, JP-A-7-11432, U.S. Pat. No. 5,380,635, JP-A-2-68539 (page 13, left lower column, line 1 to page 14, left lower column, line 9) and JP-A-3-24539 (page 14, left lower column to page 16, right lower column). Examples of a dye which is decolorized by the processing include those described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, and U.S. Pat. Nos. 4,088,497, 4,283,487, 4,548,896 and 5,187,049.

In the present invention, it is preferred to add a decolorizable dye and a base precursor to a light-insensitive layer of the photothermographic material so that the light-insensitive layer can function as a filter layer or an antihalation layer. The photothermographic material generally comprises a light-insensitive layer in addition to a light-sensitive layer. The light-insensitive layer can be classified by the site disposed into (1) a protective layer provided on a light-sensitive layer (on the side farther from the support), (2) an interlayer provided between a plurality of light-sensitive layers or between a light-sensitive layer and a protective layer, (3) an undercoat layer provided between a light-sensitive layer and a support, and (4) a back layer provided on the side opposite to the light-sensitive layer. The filter layer is provided as a layer of (1) or (2) in the light-sensitive material, and the antihalation layer is provided as a layer of (3) or (4) in the light-sensitive material.

The decolorizable dye and the base precursor are preferably added to the same light-insensitive layer and may be separately added to two adjacent light-insensitive layers. Also, a barrier layer may be provided between the two light-insensitive layer.

For adding the decolorizable dye to a light-insensitive layer, a method of adding a solution, an emulsified product, a solid fine particle dispersion or a polymer impregnated product to a coating solution for a light-insensitive layer may be used. Also, a dye may be added to the light-insensitive layer using a polymer mordant. The method for adding the dye is the same as the method usually used for adding a dye to a photothermographic material. The latex for use in the polymer impregnated product is described in U.S. Pat. No. 4,199,363, West German Patent Publication (DOS) Nos. 2,514,127 and 2,541,230, Unexamined European Patent Publication 029104, and JP-B-53-41091. The emulsification method of adding a dye to a solution having dissolved therein a polymer is described in International Patent Publication No. 88/00723.

The amount of the decolorizable dye added is determined according to the use of the dye. In general, it is used in an amount of giving an optical density (absorbency) in excess of 0.1 when measured at the objective wavelength. The optical density is preferably from 0.2 to 2. For obtaining such an optical density, the amount of the dye used is generally on the order of from 0.001 to 1 g/$m^2$, preferably on the order of from 0.005 to 0.8 g/$m^2$, more preferably on the order of from 0.01 to 0.2 g/$m^2$.

By decolorizing such a dye, the optical density can be reduced to 0.1 or less. Two or more decolorizable dyes may be used in combination in the thermally decolorizable recording material or photothermographic material. Also, two or more base precursors may be used in combination.

The photothermographic material of the present invention is preferably a so-called single face light-sensitive material comprising a support having on one side thereof at least one light-sensitive layer containing a silver halide emulsion and on the other side a back layer.

In the present invention, the single face light-sensitive material may contain a matting agent for improving the transportation property. The matting agent is generally a water-insoluble organic or inorganic compound fine particle. Any matting agent may be used and those well known in the art may be used, such as organic matting agents described in U.S. Pat. Nos. 1,939,213, 2,701,245, 2,322,037, 3,262,782, 3,539,344 and 3,767,448, and inorganic matting agent described in U.S. Pat. Nos. 1,260,772, 2,192,241, 3,257,206, 3,370,951, 3,523,022 and 3,769,020. Specific examples of the organic compound which can be preferably used as the matting agent include water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch, ureaformaldehyde-starch reaction product; and gelatin hardened by a known hardening agent, and hardened gelatin formed into a fine capsule hollow particulate by the coacervation hardening. Examples of the inorganic compound which can be preferably used include silicon dioxide, titanium dioxide, magnesium dioxide, aluminum oxide, barium sulfate, calcium carbonate, silver chloride desensitized by a known method, silver bromide desensitized by a known method, glass and diatomaceous earth. The matting agent may be used by mixing a different kind of substance, if desired. The size and the shape of the matting agent are not limited and the matting agent used may have any particle size. The matting agent used in the practice of the present invention preferably has a particle size of from 0.1 to 30 μm, more preferably an average particle size of from 2 to 10 μm. The particle size distribution of the matting agent may be either narrow or broad. However, the matting agent has a great effect on the haze or surface gloss of the light-sensitive material, therefore, the particle size, the shape and the particle size distribution are preferably controlled as necessary at the preparation of the matting agent or by mixing a plurality of matting agents.

The amount of the matting agent coated per 1 $m^2$ of the light-sensitive material is preferably from 1 to 400 $mg/m^2$, more preferably from 5 to 300 $mg/m^2$.

The degree of matting on the emulsion surface may be any as long as a stardust failure does not occur, however, the Beck smoothness is preferably from 50 to 10,000 seconds, more preferably from 80 to 10,000 seconds.

With respect to the degree of matting on the back layer for use in the present invention, the Beck smoothness is preferably from 10 to 250 seconds, more preferably from 50 to 180 seconds.

In the present invention, the matting agent is preferably contained in an outermost surface layer, a layer functioning as the outermost surface layer, or a layer close to the outer surface, and also preferably contained in a layer acting as a protective layer.

In the present invention, the binder suitable for the back layer for is transparent or translucent and generally colorless. A natural polymer, a synthetic resin, polymer or copolymer or other film-forming medium may be used. Examples thereof include gelatin, gum arabi, poly(vinyl alcohol), hydroxyethyl cellulose, cellulose acetate, cellulose acetate butyrate, poly(vinyl pyrrolidone), casein, starch, poly (acrylic acid), poly(methyl methacrylate), poly(vinyl chloride), poly(methacrylic acid), copoly-(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly(vinylidene chloride), poly(epoxides), poly (carbonates), poly(vinyl acetate), cellulose esters and poly (amides). The binder may also be formed by the coating from water, an organic solvent or an emulsion.

In the present invention, the back layer preferably has an absorption maximum at the desired wavelength region of from 0.3 to 2, more preferably has an absorption of from 0.5 to 2 and an absorption in the visible light region of from 0.001 to less than 0.5, still more preferably has an optical density of from 0.001 to less than 0.3. Examples of the antihalation dye for use in the back layer are the same as those described for the antihalation layer.

A backside resistive heating layer described in U.S. Pat. Nos. 4,460,681 and 4,374,921 may also be used in the photothermographic photographic image system.

The layers for use in the present invention such as a light-sensitive layer, a protective layer and a back layer, each may use a hardening agent. For example, a hardening agent used in the method described in T. H. James, *The Theory of the Photographic Process Fourth Edition*, pp. 77–87, Macmillan Publishing Co., Inc. (1977) may be used, and polyvalent metal ion described in *ibid.*, page 78, polyisocyanates described in U.S. Pat. No. 4,281,060 and JP-A-6-208193, epoxy compounds described in U.S. Pat. No. 4,791,042, and vinyl sulfone-base compounds described in JP-A-62-89048 are preferably used. Examples of the hardening agent include chromium salts, aldehyde salts (e.g., formaldehyde, glyoxal, glutaraldehyde), N-methylol compounds (e.g., dimethylolurea), active halogen compounds (e.g., 2,4-dichloro-6-hydroxy-1,3,5-triazine and sodium salt thereof), active vinyl compounds (e.g., 1,3-bis-vinylsulfonyl-2-propanol, 1,2-bis(vinylsulfonylacetamide)-ethane, bis (vinylsulfonylmethyl)ether, vinyl-base polymer having a vinylsulfone group on the side chain), N-carbamoylpyridinium salts (e.g., (1-morpholinocarbonyl-3-pyridinio)methane sulfonate), and haloamidinium salts (e.g., 1-(1-chloro-1-pyridinomethylene)pyrrolidinium-2-naphthalene sulfonate).

The hardening agent is added as a solution and the timing of adding the solution to the coating solution for the protective layer is from 180 minutes to immediately before the coating, preferably from 60 minutes to 10 seconds before the coating. The mixing method and conditions are not particularly limited. To speak specifically, a method of mixing the solutions in a tank designed such that the average residence time calculated from the addition flow rate and the liquid transfer amount to the coater is set to a desired time, or a method using a static mixer described in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989) may be used.

The light-sensitive material of the present invention preferably contains an antifungal described in JP-A-63-271247 so as to prevent mold and various bacteria from proliferating in a hydrophilic colloid layer and deteriorating the image.

In the present invention, a surface active agent may be used so as to improve the coatability and electrostatic charging property. Examples of the surface active agent include nonionic, anionic, cationic and fluorine-base surface active agents and any of these may be used appropriately.

Specific examples thereof include fluorine-base polymer surface active agents described in JP-A-62-170950 and U.S. Pat. No. 5,380,644, fluorine-base surface active agents described in JP-A-60-244945 and JP-A-63-188135, polysiloxane-base surface active agents described in U.S. Pat. No. 3,885,965, and polyalkylene oxides and anionic surface active agents described in JP-A-6-301140.

Examples of the solvent for use in the present invention include those described in *Shin-Han Yozai Pocketbook* (*New Version, Solvent Pocketbook*), Ohm Sha (1994), however, the present invention is by no means limited thereto. The solvent for use in the present invention preferably has a boiling point of from 40 to 180° C.

Specific examples of the solvent for use in the present invention include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine and water.

The photographic emulsion layer and other hydrophilic colloid layers may be coated using various known coating methods such as dip coating, roller coating, curtain coating and extrusion coating. If desired, multiple layers may be simultaneously coated by the coating method described in U.S. Pat. Nos. 2,681,294, 2,761,791, 3,526,528 and 3,508,947.

In the light-sensitive material of the present invention, a dye (e.g., oxonol dye, cyanine dye) capable of being decolorized by the processing described in European Patent 337,490A2, pp. 27–76 is preferably added to a hydrophilic colloid layer in order to prevent irradiation and halation or to improve safelight safety. Also, a dye which is contained in a hydrophilic colloid layer in the state of a solid particle dispersion and decolorized by the development, is preferably used, such as dyes described in JP-A-2-282244, pp. 3–8, and JP-A-3-7931, pp. 3–11. In addition, hemioxonol dyes, styryl dyes, merocyanine dyes, anthraquinone dyes, azo dyes, azomethine dyes, triarylmethane dyes and phthalocyanine dyes are also useful. Furthermore, an oil-soluble dye may also be added to a hydrophilic colloidal layer after emulsifying the dye by the oil-in-water dispersion method. In the case of using such dyes, it is preferred to select and use a dye having such an absorption that the spectral sensitivity of a layer sensitive to the longest wave overlaps the maximum absorption. By using such dyes, the light-sensitive layer is preferably adjusted to have an optical density (logarithm of reciprocal value of transmitted light and in the case of reflective support, reflection density) at 680 nm or at a wavelength of a laser used for the exposure, of 0.5 or more so as to improve the sharpness.

The photographic emulsion for use in the present invention may be coated on a support of various types. Typical examples of the support include a polyester film, an undercoated polyester film, a poly(ethylene terephthalate) film, a polyethylene naphthalate film, a cellulose nitrate film, cellulose acetate, cellulose acetate butyrate, polystyrene, polyvinyl chloride, a cellulose ester film, a poly(vinyl acetal) film, a polycarbonate film, a material in the resin form, glass, earthenware, paper and metal. A flexible base material, particularly a paper support coated by a partially acetylated or baryta and/or α-olefin polymer, preferably by a polymer of α-olefin polymer having from 2 to 10 carbon atoms, such as polyethylene, polypropylene or ethylene-butene copolymer, is typically used. The support may be colored using a dye or pigment or may be colored black for the purpose of light shielding. The support may be transparent or opaque but is preferably transparent.

The surface of the support is generally subjected to undercoating treatment to enhance the adhesion with the silver halide emulsion layer. The surface of the support may be further subjected to glow discharge, corona discharge, irradiation with ultraviolet ray or flame treatment before or after the undercoating treatment.

The light-sensitive material of the present invention may have an antistatic or electrically conductive layer, for example, a soluble salt (e.g., chloride, nitrate) vacuum deposited metal layer or a layer containing an ionic polymer described in U.S. Pat. Nos. 2,861,056 and 3,206,312 or an insoluble inorganic salt described in U.S. Pat. No. 3,428,451.

The photothermographic material is preferably a monosheet type (a type where an image can be formed on the photothermographic material without using another sheet such as image-receiving material).

The photothermographic material may further contain an antioxidant, a stabilizer, a plasticizer, an ultraviolet absorbent and a coating aid. These various additives are added to either a light-sensitive layer or a light-insensitive layer. This is described in WO98/36322, EP803764A1, JP-A-10-186567 and JP-A-10-18568.

The light-sensitive layer for use in the present invention may use, as a plasticizer or a lubricant, a polyhydric alcohol (for example, glycerins and diols described in U.S. Pat. No. 2,960,404), a fatty acid or ester described in U.S. Pat. Nos. 2,588,765 and 3,121,060, or a silicone resin described in British Patent 955,061.

With respect to the method for obtaining a color image using the photothermographic material of the present invention, the method is described in JP-A-7-13295, page 10, left column, line 43 to page 11, left column, line 40. Examples of the stabilizer for the color dye image are described in British Patent 1,326,889 and U.S. Pat. Nos. 3,432,300, 3,698,909, 3,574,627, 3,573,050, 3,764,337 and 4,042,394.

The coating of the photothermographic material of the present invention may be performed by any method. Various coating operations such as extrusion coating, slide coating, curtain coating, dip coating, knife coating, flow coating or extrusion coating using a hopper described in U.S. Pat. No. 2,681,294 may be used. Among these, the extrusion coating or slide coating described in Stephen F. Kistler and Petert M. Schweizer, *LIQUID FILM COATING*, pp. 399–536, CHAPMAN & HALL (1977), are preferred, and the slide coating is more preferred. An example of the shape of the slide coater used in the slide coating is shown in FIG. 11b.1 of *ibid.*, page 427. If desired, two or more layers may be simultaneously coated using a method described in *ibid.*, pp. 399–536, U.S. Pat. No. 2,761,791 and British Patent 837,095.

The photothermographic material of the present invention may contain additional layers such as a dye-accepting layer for accepting a mobile dye image, an opacifying layer when reflective printing is intended, a protective topcoat layer and a primer layer known in the light-heat photographic technology. The light-sensitive material of the present invention is preferably a type of forming an image only by one sheet of the light-sensitive material without using another light-sensitive material of functional layers necessary for forming the image, such as an image-receiving layer.

The light-sensitive material of the present invention may be developed by any method, however, the light-sensitive material after imagewise exposure is usually developed by raising the temperature. The development temperature is preferably from 80 to 250° C., more preferably from 100 to 140° C. The development time is preferably from 1 to 180 seconds, more preferably from 10 to 90 seconds, still more preferably from 10 to 40 seconds.

The heat development is preferably performed by a plate heater method. As the heat development according to the plate heater method, the method described in JP-A-11-133572 is preferred. The heat developing apparatus used forms a visible image by contacting a photothermographic material having formed thereon a latent image with heating means in the heat-developing section, where the heating means comprises a plate heater, a plurality of press rollers are disposed to face each other along one surface of the plate heater, and the photothermographic material is heat developed by passing between the press rollers and the plate heater. The plate heater is preferably divided into from 2 to 6 stages and reduced in the temperature at the leading end by approximately from 1 to 10° C. Such a method is described also in JP-A-54-30032, where the water content or organic solvent contained in the photothermographic material can be excluded out of the system and the photothermographic material can be prevented from the change of the support shape which is caused upon abrupt heating of the photothermographic material.

The light-sensitive material of the present invention may be exposed by any method, but the light source for exposure is preferably a laser. The laser for use in the present invention is preferably a gas laser (e.g., $Ar^+$, He—Ne), a YAG laser, a dye laser or a semiconductor laser. Also, a semiconductor laser combined with a second harmonic generating device may be used. A gas or semiconductor laser capable of emitting light of from red to infrared is preferred.

The laser may be a single-mode laser, however, the photothermographic material of the present invention is liable to generate interference fringes due to the low haze at the exposure and for preventing generation of interference fringes, a technique of obliquely entering a laser ray to the light-sensitive material disclosed in JP-A-5-113548 and a method of using a multi-mode laser disclosed in W095/31754 are known and may be used.

The photothermographic material of the present invention is preferably exposed such that the laser rays are overlapped and the scanning line is not observed as disclosed in *SPIE*, Vol. 169, Laser Printing, pp. 116–128 (1979), JP-A-4-51043 and WO95/31754.

The laser output is preferably 1 mW or more, more preferably 10 mW or more, still more preferably 40 mW or more. At this time, a plurality of lasers may be combined. The laser ray may have a diameter in terms of a $1/e^2$ spot size of Gaussian beam, approximately from 30 to 200 $\mu$m.

The photothermographic material of the present invention forms a black-and-white silver image and is preferably used as a photothermographic material for medical diagnosis, a photothermographic material for industrial photography, a photothermographic material for printing or a photothermographic material for COM. In the case of medical diagnosis use, from the black-and-white image formed, a duplicate image may be formed on a duplication film MI-Dup produced by Fuji Photo Film Co., Ltd. In the case of printing use, the black-and-white image formed can be of course used as a mask for forming an image on a dot-to-dot work film DO-175 or PDO-100 produced by Fuji Photo Film Co., Ltd. or on an offset printing plate.

The present invention is described in greater detail below by referring to Examples, but the present invention should not be construed as being limited thereto.

EXAMPLE 1

Preparation of Silver Halide Grains

To a solution obtained by adding 3.1 ml of a 1 wt % aqueous potassium bromide solution, 3.5 ml of a 1N aqueous sulfuric acid solution and 31.7 g of phthalized gelatin to 1,420 ml of distilled water, 97.4 ml of a 1.37N aqueous potassium bromide solution (Solution a) and 95.4 ml of a 1.37N aqueous silver nitrate solution (Solution b) were added by a double jet method over 45 seconds while keeping the liquid temperature at 39° C. and stirring in a stainless steel-made reaction pot. Subsequently, 10 ml of a 3.5 wt % aqueous hydrogen peroxide solution was added and further, 10.8 ml of a 10 wt % aqueous solution of Compound 1 was added. Thereafter, 317.5 ml of a 0.96 N aqueous silver nitrate solution (Solution c) was added together with a 0.96N aqueous potassium bromide solution (Solution d) by a controlled double jet method over 30 minutes while keeping the pAg at 7.7. During this addition, an aqueous tripotassium iridium hexachloride solution was added in the entire amount at once to have a final concentration of $1\times10^{-4}$ mol per mol of silver. The pH was adjusted to 3.8 by adding 25 ml of a 1 wt % aqueous potassium bromide solution and 33 ml of a 1N aqueous sulfuric acid solution, the stirring was stopped, the solution was subjected to the precipitation/desalting/water washing, $2.6\times10^{-4}$ mol/mol-Ag of Compound 2 was added, 1N sodium hydroxide and a 1 wt % aqueous potassium bromide solution were added, and the pH and the pAg were adjusted at 37° C. to 5.9 and 8.2, respectively. Thus, a silver halide dispersion was prepared.

While stirring the emulsion obtained, $5\times10^{-3}$ mol/mol-Ag of Spectral Sensitizing Dye A was added at 37° C. After 1 minute, the temperature was elevated to 47° C. and after 18 minutes, $3\times10^{-5}$ mol/mol-Ag of Compound 3 was added. After 5 minutes from that, $5\times10^{-5}$ mol/mol-Ag of Tellurium Sensitizer B was added and the solution was ripened for 80 minutes. Just before the completion of ripening, $1\times10^{-4}$ mol/mol-Ag of Compound 4 was added, the temperature was lowered to 30° C., and 22.2 ml of a methanol solution containing 1 wt % of Compound 5 and 3 wt % of Compound 6 was added the chemical sensitization was completed and Emulsion 1 was prepared. The grains in the silver halide emulsion prepared were pure silver bromide grains having an average sphere-equivalent diameter of 0.057 $\mu$m and a coefficient of variation of the sphere-equivalent diameter of 22%. The grain size was determined as an average of 500 grains using an electron microscope.

Emulsions 2 to 11 shown in Table 1 were prepared thoroughly in the same manner as in Emulsion 1 except that an additive shown in Table 1 was added 5 minutes after the completion of addition of the aqueous silver nitrate solution (Solution c) and the amounts of chemical sensitizers and sensitizing dyes were adjusted to give an optimal sensitivity in the sensitometry which is described later.

Compound 1

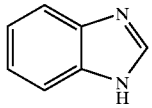

-continued

Compound 2

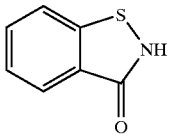

Compound 3

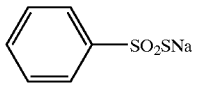

Compound 4

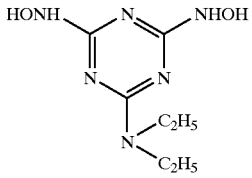

Compound 5

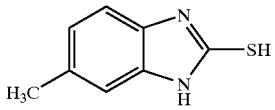

Compound 6

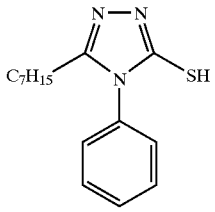

Compound 7

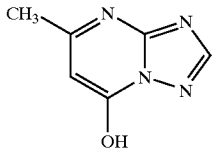

Compound 8

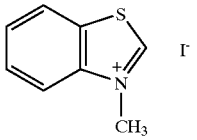

Spectral Sensitizing Dye A

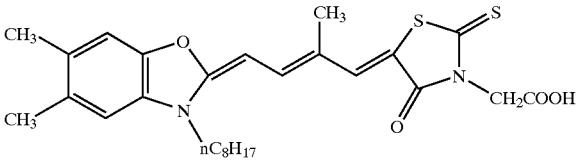

Tellurium Sensitizer B

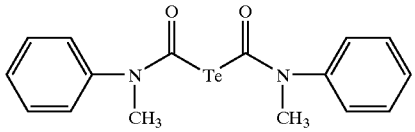

TABLE 1

| Emulsion No. | Additive (amount added: mol/mol-Ag) | Grain size, μm | Coefficient of Variation | |
|---|---|---|---|---|
| 1 | — | 0.057 | 22% | Comparison |
| 2 | $K_4[Fe(CN)_6]$ ($1 \times 10^{-4}$) | 0.055 | 23% | Invention |
| 3 | $K_4[Fe(CN)_6]$ ($3 \times 10^{-4}$) | 0.054 | 23% | " |

TABLE 1-continued

| Emulsion No. | Additive (amount added: mol/mol-Ag) | Grain size, μm | Coefficient of Variation | |
|---|---|---|---|---|
| 4 | $K_4[Fe(CN)_6]$ ($1 \times 10^{-3}$) | 0.052 | 20% | " |
| 5 | $K_4[Fe(CN)_6]$ ($3 \times 10^{-3}$) | 0.051 | 22% | " |
| 6 | $K_4[Fe(CN)_6]$ ($1 \times 10^{-2}$) | 0.046 | 21% | " |
| 7 | $K_4[Ru(CN)_6]$ ($3 \times 10^{-4}$) | 0.054 | 22% | " |
| 8 | Compound 7 ($1 \times 10^{-4}$) | 0.057 | 23% | Comparison |
| 9 | Compound 7 ($1 \times 10^{-3}$) | 0.057 | 21% | " |
| 10 | Compound 7 ($1 \times 10^{-2}$) | 0.056 | 22% | " |
| 11 | Compound 7 ($1 \times 10^{-1}$) | 0.048 | 23% | " |

To each of Emulsions 1 to 11, gelatin and sodium dodecylbenzenesulfonate were added, and respective emulsions were coated on a triacetyl cellulose film support having an undercoat layer together with a protective layer containing gelatin, polymethyl methacrylate particles and 2,4-dichloro-6-hydroxy-s-triazine sodium salt by an extrusion method to have a silver amount of 10 g/m$^2$ and a gelatin amount of 2.3 g/m$^2$ to obtain Coated Samples 1 to 11, respectively.

These samples each was subjected to sensitometry exposure ($10^{-3}$ second) through an optical wedge with an SC-52 filter, developed with Developer MAA-1 having the following formulation at 20° C. for 10 minutes, followed by stopping, fixing, water washing and drying in an usual manner, and then determined on the optical density.

The fog was determined by the minimum optical density of Samples.

The sensitivity was expressed by a reciprocal of the exposure amount necessary for obtaining an optical density of fog+0.1, as a relative value when the value of Sample 1 is 100.

Dmax was obtained by the maximum optical density of Samples.

| MAA-1 Developer: | |
|---|---|
| Metol | 2.5 g |
| L-Ascorbic acid | 10.0 g |
| Nabox | 35.0 g |
| KBr | 1.00 g |
| Water to make | 1 liter |

TABLE 2

| Sample | Fog | Relative Sensitivity | Dmax | |
|---|---|---|---|---|
| 1 | 0.12 | 100 | 2.00 | Comparison |
| 2 | 0.12 | 101 | 2.10 | Invention |
| 3 | 0.11 | 100 | 2.20 | " |
| 4 | 0.12 | 100 | 2.13 | " |
| 5 | 0.10 | 80 | 1.97 | " |
| 6 | 0.09 | 50 | 1.80 | " |
| 7 | 0.11 | 101 | 2.10 | " |
| 8 | 0.11 | 102 | 2.01 | Comparison |
| 9 | 0.12 | 100 | 2.00 | " |
| 10 | 0.11 | 10 | 1.80 | " |
| 11 | 0.09 | 2 | 1.01 | " |

As seen from Table 2, when a tetrazaindene compound was used in an amount of $10^{-1}$ mol/mol-Ag, the silver halide grain size surely became small, however, serious reduction in the sensitivity also occurred. The emulsions where the hexacyano complex of the present invention was added were verified to have a small grain size, be free of reduction in the sensitivity, and exhibit an effect of increasing the Dmax.

EXAMPLE 2

Emulsions 12 to 14 were prepared in the same manner as Emulsion 1 in Example 1 except that an additive and a dopant shown in Table 3, the dopant being dissolved in a potassium bromide solution (Solution d), were added at the preparation of silver halide. In the case of Emulsion 15, the addition of an iridium complex was further excluded from the preparation of Emulsion 3.

TABLE 3

| Emulsion No. | Additive (amount added: mol/mol-Ag) | Dopant (amount added: mol/mol-Ag) | Grain Size, μm | Coefficient of Variation | |
|---|---|---|---|---|---|
| 1 | — | — | 0.057 | 22% | Comparison |
| 3 | $K_4[Fe(CN)_6]$ ($3 \times 10^{-4}$) | — | 0.054 | 23% | Invention |
| 12 | $K_4[Fe(CN)_6]$ ($3 \times 10^{-4}$) | $K_4[Fe(CN)_6]$ ($1 \times 10^{-5}$) | 0.054 | 24% | " |
| 13 | $K_4[Fe(CN)_6]$ ($3 \times 10^{-4}$) | $K_4[Ru(CN)_6]$ ($1 \times 10^{-5}$) | 0.055 | 22% | " |
| 14 | $K_4[Fe(CN)_6]$ ($3 \times 10^{-4}$) | $K_4(Fe(CN)_6]$ ($3 \times 10^{-4}$) | 0.053 | 23% | " |
| 15 | $K_4[Fe(CN)_6)$ ($3 \times 10^{-4}$) | — | 0.053 | 23% | " |

These emulsions each was coated, exposed and developed in the same manner as in Example 1. The results obtained are shown in Table 4 below.

TABLE 4

| Sample | Fog | Relative Sensitivity | Dmax | |
|---|---|---|---|---|
| 1 | 0.12 | 100 | 2.00 | Comparison |
| 3 | 0.11 | 100 | 2.20 | Invention |
| 12 | 0.11 | 110 | 2.22 | " |
| 13 | 0.12 | 115 | 2.19 | " |
| 14 | 0.11 | 105 | 2.21 | " |
| 15 | 0.12 | 70 | 2.19 | " |

It is seen from Table 4 that when a hexacyano metal complex was further doped, the sensitivity was more elevated while maintaining the small grain size. Also, when an iridium complex was doped, the sensitivity was elevated.

EXAMPLE 3

Preparation of PET Support

PET having an intrinsic viscosity IV=0.66 (measured in phenol/tetrachloroethane=6/4 (by weight) at 25° C.) was obtained by an ordinary method using terephthalic acid and ethylene glycol. The PET was pelletized, dried at 130° C. for 4 hours, melted at 300° C., extruded from a T-die and rapidly cooled to prepare an unstretched film having a thickness such that the thickness after the heat setting was 175 μm.

This film was vertically stretched to 3.3 times using rolls different in the peripheral speed and then horizontally stretched to 4.5 times by a tenter. At this time, the temperatures were 110° C. and 130° C., respectively. Subsequently, the film was heat set at 240° C. for 20 seconds and horizontally relaxed by 4% at the same temperature. Thereafter, the chuck part of the tenter was slit, both edges of the film were knurled, and the film was taken up at 4 kg/cm$^2$ to obtain a roll having a thickness of 175 μm.

Surface Corona Treatment

Both surfaces of the support was treated at room temperature at 20 m/min using a solid state corona treating machine Model 6KVA manufactured by PILLAR. From the current and voltage read, the support had a treatment of 0.375 kV·A·min/m$^2$ at this time. The treatment frequency was 9.6 kHz and the gap clearance between the electrode and the dielectric roll was 1.6 mm.

Preparation of Undercoated Support (1) Undercoating (1-1) Coating of Undercoat Layer

| | |
|---|---|
| Formulation (1) (First Layer): | |
| Butadiene-styrene copolymer latex (solid content: 43 wt %, butadiene/styrene weight ratio: 32/68) | 13 ml |
| 2,4-Dichloro-6-hydroxy-S-triazine sodium salt, 8 wt % aqueous solution | 7 ml |
| Sodium laurylbenzenesulfonate, 1 wt % aqueous solution | 1.6 ml |
| Distilled water | 80 ml |
| Formulation (2) (Second Layer on Light-Sensitive Layer Side): | |
| Gelatin | 0.9 g |
| 20 wt % Dispersion of pigment | 1 g |
| Methyl cellulose (Metrose SM15, degree of substitution: 1.79 to 1.83) | 0.1 g |
| Acetic acid (concentration: 99 wt %) | 0.02 ml |
| Distilled water | 98 ml |
| Formulation (3) (Second Layer on Back Surface Side): | |
| $SnO_2$/Sb (9/1 by weight, average particle size: 0.25 μm) | 100 mg/m$^2$ |
| Gelatin | 77 mg/m$^2$ |
| Sodium dodecylbenzenesulfonate | 1 mg/m$^2$ |
| Sodium dihexyl-α-sulfosuccinate | 4 mg/m$^2$ |

Preparation of Undercoated Support

Both surfaces the 175 μm-thick biaxially stretched polyethylene terephthalate support obtained above was subjected to the above-described corona discharge treatment and thereon the undercoat coating solution formulation (1) was coated by a wire bar to have a wet coated amount of 6 ml/m$^2$ (per one surface) and dried at 180° C. for 5 minutes. Thereafter, this one surface (light-sensitive layer surface) was subjected to corona discharge treatment and thereon the undercoat coating solution formulation (2) was coated by a wire bar to have a wet coated amount of 9 mi/m$^2$ and dried at 180° C. for 5 minutes. Furthermore, on the back surface, the undercoat coating solution formulation (3) was coated by a wire bar to have a wet coated amount of 5 ml/m$^2$ and dried at 180° C. for 6 minutes to obtain an undercoated support.

Preparation of Coating Solution for Back Surface
Preparation of Solid Fine Dispersion Solution (a) of Base Precursor 64 g of Base Precursor Compound 9, 28 g of Diphenylsulfone Compound 10 and 10 g of a surface active agent Demol N produced by Kao Corporation were mixed with 220 ml of distilled water, and the mixed solution was dispersed using beads in a sand mill (1/4 Gallon Sand Grinder Mill, manufactured by Imex K.K.) to obtain Solid Fine Particle Dispersion Solution (a) of base precursor compound, having an average particle size of 0.2 μm.

Base Precursor Compound 9:

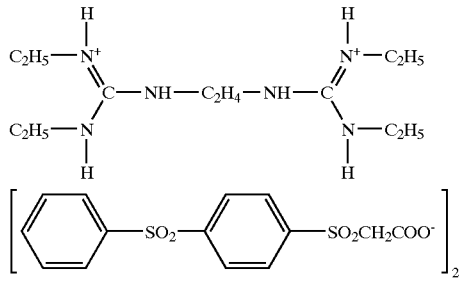

Compound 10:

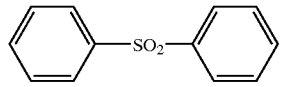

Preparation of Solid Fine Particle Dispersion Solution of Dye 9.6 g of Cyanine Dye Compound 11 and 5.8 g of sodium p-alkylbenzenesulfonate were mixed with 305 ml of distilled water and the mixed solution was dispersed using beads in a sand mill (1/4 Gallon Sand Grinder Mill, manufactured by Imex K.K.) to obtain a solid fine particle dispersion solution of dye, having an average particle size of 0.2 $\mu$m.

Preparation of Coating Solution for Antihalation Layer 17 g of gelatin, 9.6 g of polyacrylamide, 70 g of Solid Fine Particle Dispersion Solution (a) of base precursor obtained above, 56 g of the solid fine particle dispersion solution of dye obtained above, 1.5 g of polymethyl methacrylate fine particles (average particle size: 6.5 $\mu$m), 2.2 g of sodium polyethylene sulfonate, 0.2 g of Blue Dye Compound 12 and 844 ml of $H_2O$ were mixed to prepare a coating solution for the antihalation layer.

Cyanine Dye Compound 11:

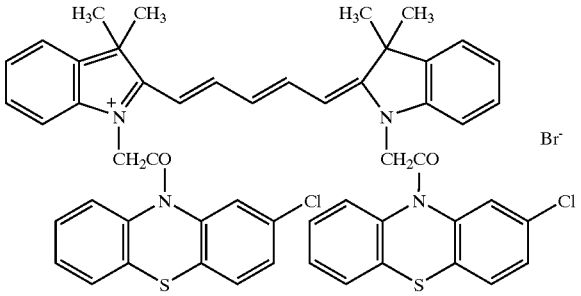

-continued

Blue Dye Compound 12:

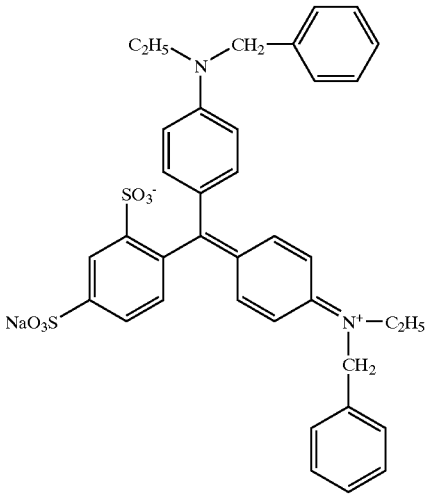

Preparation of Coating Solution for Protective Layer on Back Surface

In a container kept at 40° C., 50 g of gelatin, 0.2 g of sodium polystyrenesulfonate, 2.4 g of N,N-ethylenebis-(vinylsulfonacetamide), 1 g of sodium t-octylphenoxy-ethoxyethanesulfonate, 30 mg of Compound 4, 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization weight ratio: 5/95) and 950 ml of $H_2O$ were mixed to prepare a coating solution for the protective layer on the back surface.

Preparation of Silver Halide Grain

Emulsions of Examples 1 and 2 were used as it is. Before the addition to a coating solution (described later), $7\times10^{-3}$ mol/mol-Ag of a 1 wt % aqueous solution of Compound 8 was added to each emulsion.

Preparation of Scale-Shaped Silver Salt of Fatty Acid 87.6 g of behenic acid (Edenor C22-85R, product name, produced by Henckel), 423 ml of distilled water, 49.2 ml of an aqueous 5N-NaOH solution and 120 ml of tert-butanol were mixed and reacted by stirring at 75° C. for 1 hour to obtain a sodium behenate solution. Separately, 206.2 ml (pH: 4.0) of an aqueous solution containing 40.4 g of silver nitrate was prepared and kept at 10° C. To a reaction vessel containing 635 ml of distilled water and 30 ml of tert-butanol and kept at 30° C., the entire amount of the sodium behenate solution prepared above and the entire amount of the aqueous silver nitrate solution prepared above were added while stirring at a constant flow rate over 62 minutes and 10 seconds, and 60 minutes, respectively. At this time, for 7 minutes and 20 seconds after the initiation of addition of the aqueous silver nitrate solution, only the aqueous silver nitrate solution was added, then the addition of the sodium behenate solution was started, and for 9 minutes and 30 seconds after the completion of addition of the aqueous silver nitrate solution, only the sodium behenate solution was added. The temperature in the reaction vessel was 30° C. and the ambient temperature was controlled to prevent the liquid temperature from rising. The pipeline for the addition system of the sodium behenate solution was kept warm by the steam tracing where the steam opening was controlled to set the liquid temperature at the tip of addition nozzle to 75° C. The pipeline for the addition system of the aqueous silver nitrate solution was kept cold by circulating chilled water outside the duplex tube. The site where the sodium behenate solution was added and the site where the aqueous silver nitrate solution was added were symmetrized with respect to the stirring axis as the center. The heights were adjusted to prevent the solutions from contacting with the reaction solution.

After the completion of addition of the sodium behenate solution, the mixed solution was allowed to stand while stirring at the same temperature for 20 minutes and then, the temperature was lowered to 25° C. Thereafter, the solid content was separated by the suction filtration and washed with water until the conductivity of the filtered water became 30 μS/cm. Thus, silver salt of fatty acid was obtained. The solid content obtained was stored as a wet cake without drying.

The form of the silver behenate particles obtained was evaluated by the photographing through an electron microscope, then, the particles were found to be scale crystals of a=0.14 μm, b=0.4 μm and c=0.6 μm on average, having a variation coefficient of the average sphere-equivalent diameter of 15%.

To the wet cake corresponding to 100 g of dry content, 7.4 g of polyvinyl alcohol (PVA-205, trade name) and water were added to make the total amount of 385 g and the resulting solution was preliminarily dispersed in a homomixer.

The stock solution after the preliminary dispersion was treated three times in a dispersing machine (Microfluidizer M-110S-EH, trade name, manufactured by Microfluidex International Corporation, using G10Z interaction chamber) of which pressure was adjusted to 1,750 kg/cm$^2$. Thus, a silver behenate dispersion was obtained. At this time, the cooling operation was performed by the coiled heat exchangers installed before and after the interaction chamber and the temperature of the refrigerant was controlled to give a desired dispersion temperature.

Preparation of 25% Dispersion of Reducing Agent

To 80 g of 1,1-bis(2-hydroxy-3,5-dimethylphenyl)-3,5,5-trimethylhexane and 64 g of a 20% aqueous solution of modified polyvinyl alcohol Poval MP203 produced by Kuraray Co., Ltd., 176 g of water was added and thoroughly mixed to form a slurry. The slurry was placed in a vessel together with 800 g of zirconia beads having an average diameter of 0.5 mm and dispersed for 5 hours in a dispersing machine (1/4G Sand Grinder Mill, manufactured by Imex K.K.) to obtain a reducing agent dispersion. The reducing agent particles contained in the thus-obtained reducing agent dispersion had an average particle size of 0.72 μm.

Preparation of 20% Dispersion of Mercapto Compound

To 64 g of Compound 6 and 32 g of a 20% aqueous solution of modified polyvinyl alcohol Poval MP203 produced by Kuraray Co., Ltd., 224 g of water was added and thoroughly mixed to form a slurry. The slurry was placed in a vessel together with 800 g of zirconia beads having an average diameter of 0.5 mm and dispersed for 10 hours in a dispersing machine (1/4G Sand Grinder Mill, manufactured by Imex K.K.) to obtain a mercapto compound dispersion. The mercapto compound particles contained in the thus-obtained mercapto compound dispersion had an average particle size of 0.67 μm.

Preparation of 30% Dispersion of Organic Polyhalogen Compound

To 48 g of tribromomethylphenylsulfone, 48 g of 3-tribromomethylsulfonyl-4-phenyl-5-tridecyl-1,2,4-triazole and 48 g of a 20% aqueous solution of modified polyvinyl alcohol Poval MP203 produced by Kuraray Co., Ltd., 224 g of water was added and thoroughly mixed to form a slurry. The slurry was placed in a vessel together with 800 g of zirconia beads having an average diameter of 0.5 mm and dispersed for 5 hours in a dispersing machine (1/4G Sand Grinder Mill, manufactured by Imex K.K.) to obtain an organic polyhalogen compound dispersion. The organic polyhalogen compound particles contained in the thus-obtained organic polyhalogen dispersion had an average particle size of 0.74 μm.

Preparation of 10 wt % Methanol Solution of Phthalazine Compound

A solution obtained by dissolving 10 g of 6-isopropylphthalazine in 90 g of methanol was used.

Preparation of 20% Dispersion of Pigment

To 64 g of C.I. Pigment Blue 60 and 6.4 g of Demol N produced by Kao Corporation, 250 g of water was added and thoroughly mixed to form a slurry. The slurry was placed in a vessel together with 800 g of zirconia beads having an average diameter of 0.5 mm and dispersed for 25 hours in a dispersing machine (1/4G Sand Grinder Mill, manufactured by Imex K.K.) to obtain a pigment dispersion. The pigment particles contained in the thus-obtained pigment dispersion had an average particle size of 0.21 μm.

Preparation of 40 wt % SBR Latex

An ultrafiltration(UF)-purified SBR latex was obtained as follows.

The SBR latex described below was 10-fold diluted with distilled water and then dilution-purified using an UF-purification module FS03-FC-FUY03A1 (manufactured by Daicen Membrane System K.K.) until the ion conductivity became 1.5 mS/cm. The latex concentration at this time was 40%.

Preparation of SBR Latex (Latex of -St(68)-Bu (29)-AA(3)-)

Average particle size: 0.1 μm, concentration: 45%, equilibrium moisture content at 25° C. and 60% RH: 0.6 wt %, ion conductivity: 4.2 mS/cm (the measurement of ion conductivity was performed by measuring the latex stock solution (40%) at 25° C. using a conductivity meter CM-30S manufactured by Toa Denpa Kogyo K.K.), and pH: 8.2.

Preparation of Coating Solution for Emulsion Layer (Light-Sensitive Layer)

1.1 g of the 20% water dispersion of pigment, 103 g of the dispersion of the silver salt of an organic acid, 5 g of a 20 wt % aqueous solution of polyvinyl alcohol PVA-205 (produced by Kuraray Co., Ltd.), 25 g of the 25 wt % reducing agent dispersion, 11.5 g of the 30% dispersion of organic polyhalogen compound, 3.1 g of the 20% dispersion of mercapto compound, 106 g of the UF-purified 40 wt % SBR latex and 8 ml of the 20 wt % methanol solution of phthalazine compound were added to 10 g of Silver Halide Mixed Emulsion A and thoroughly mixed to prepare a coating solution for the emulsion layer. The resulting coating solution for the emulsion layer was transferred to a coating die to give a coated amount of 70 ml/m$^2$ and coated.

The viscosity of the coating solution for the emulsion layer was measured by B-Type Viscometer manufactured by Tokyo Keiki and found to be 85 [mPa·s] at 40° C. (No. 1 rotor).

The coating solution had a viscosity measured at 25° C. using RFS Field Spectrometer manufactured by Rheometrics Far East K.K., of 1,500, 220, 70, 40 and 20 [mPa·s] at a shear rate of 0.1, 1, 10, 100, 1,000 [1/sec], respectively.

Preparation of Coating Solution for Interlayer on Emulsion Surface

To 772 g of a 10 wt % aqueous solution of polyvinyl alcohol PVA-205 (produced by Kuraray Co., Ltd.), 0.7 g of the 20 wt % dispersion of pigment and 226 g of a 27.5% solution of methyl methacrylate/styrene/2-ethylhexyl acrylate/hydroxyethyl methacrylate-acrylic acid copolymer (copolymerization weight ratio: 59/9/26/5/1) latex, 2 ml of a 5 wt % aqueous solution of Aerosol TO (produced by American Cyanamide) to prepare a coating solution for the interlayer and the resulting solution was transferred to a coating die to give a coated amount of 5 ml/m$^2$.

The viscosity of the coating solution measured by the B-Type Viscometer at 40° C. (No. 1 rotor) was 21 [mpa·s].

Preparation of Coating Solution for the Protective First Layer on Emulsion Surface 80 g of inert gelatin was dissolved in water and thereto 64 ml of a 10 wt % methanol solution of phthalic acid, 74 ml of a 10 wt % aqueous solution of 4-methylphthalic acid, 28 ml of 1N sulfuric acid, 5 ml of a 5 wt % aqueous solution of Aerosol TO (produced by American Cyanamide) and 1 g of phenoxyethanol were added. Thereto, water was added to make a total amount of 1,000 g to prepare a coating solution and the coating solution was transferred to a coating die to give a coated amount of 10 ml/m$^2$.

The viscosity of the coating solution measured by the B-Type Viscometer at 40° C. (No. 1 rotor) was 17 [mPa·s].

Preparation of Coating Solution for the Protective Second Layer on Emulsion Surface 100 g of inert gelatin was dissolved in water and thereto 20 ml of a 5% solution of N-perfluorooctylsufonyl-N-propylaranine potassium salt, 16 ml of a 5 wt % solution of Aerosol TO (produced by American Cyanamide), 25 g of polymethyl methacrylate fine particles (average particle size: 4.0 $\mu$m), 1.6 g of 4-methylphthalic acid, 44 ml of 1N sulfuric acid and 10 mg of benzoisothiazoline were added. Thereto, water was added to make a total amount of 1,555 g and immediately before the coating, 445 ml of an aqueous solution containing 4 wt % of chrominum alum and 0.67 wt % of phthalic acid was mixed by a static mixer to prepare a coating solution for the surface protective layer. The resulting coating solution was transferred to a coating die to give a coated amount of 10 ml/m$^2$.

The viscosity of the coating solution measured by the B-Type Viscometer at 40° C. (No. 1 rotor) was 9 [mPa·s].

Manufacture of Photothermographic Material

On the back surface side of the above-described undercoated support, the coating solution for the antihalation layer and the coating solution for the back surface protective layer were simultaneously coated to have a solid content coated amount of 0.04 g/m$^2$ and a gelatin coated amount of 1 g/m$^2$, respectively, and dried to form an antihalation back layer.

Using Emulsion 1, an emulsion layer, an interlayer, a protective first layer and a protective second layer in this order from the undercoated surface were simultaneously coated one on another on the surface opposite to the back surface by the slide bead coating method to manufacture Photothermographic Material Sample 101.

The coating was performed at a speed of 160 m/min, the distance between the tip of the coating die and the support was set to 0.18 mm, and the pressure in the decompression chamber was set as low as 392 Pa based on the atmospheric pressure. In the subsequent chilling zone, a wind at a dry bulb temperature of 18° C. and a wet bulb temperature of 12° C. was blown for 30 seconds to cool the coating solution and in a drying zone of helical floatation system, a dry wind at a dry bulb temperature of 30° C. and a wet bulb temperature of 18° C. was blown for 200 seconds. Thereafter, the sample was passed through a drying zone at 70° C. over 30 seconds and cooled to 25° C. to vaporize the solvent in the coating solution. The winds in the chilling zone and the drying zone each was blown against the coating solution-coated surface at an average wind velocity of 7 m/sec.

Evaluation of Photographic Performance

After exposing the photographic material by a laser sensitometer (described below), the photographic material was processed (heat developed) at 118° C. for 5 seconds and subsequently at 122° C. for 16 seconds. The image obtained was evaluated by a densitometer. The graininess was evaluated by measuring the RMS value in the region of giving a density of 1.0 by a microdensitometer having an aperture diameter of 100 $\mu$m and expressed by a relative value when the value of Sample 101 was 100. As the value is smaller, the performance is better. Also, the samples not exposed were heat developed as it is and measured on the optical density so as to evaluate the minimum optical density (fog) and the maximum optical density (Dmax).

Laser Sensitometer

Combination of two 660-nm diode lasers having an output of 35 mW

Single mode

Gaussian beam spot 1/e$^2$: 100 $\mu$m

Delivered at a 25 $\mu$m pitch in the side-scanning direction to draw one picture element four times.

Evaluation of Image Preservability Against Light Irradiation

The light-sensitive materials each exposed and developed in the same manner as in the evaluation of photographic performance were fixed on Schaukasten having a luminance of 1,000 lux and allowed to stand for 10 days, and then the image was evaluated with an eye according to the following criteria.

⊙: Almost no change.

○: Tone was slightly changed but not weighed on mind.

Δ: The image area was discolored but practically tolerable.

X: Dmin was changed with increase in density and not acceptable.

TABLE 5

| Sample | Emulsion | Fog | Sensitivity | Dmax | Evaluation of Image Preservability against Light Irradiation | |
|---|---|---|---|---|---|---|
| 101 | 1 | 0.14 | 100 | 3.60 | Δ | Comparison |
| 102 | 2 | 0.13 | 101 | 3.65 | ○ | Invention |
| 103 | 3 | 0.14 | 100 | 3.81 | ○ | " |
| 104 | 4 | 0.15 | 99 | 3.83 | ○ | " |
| 105 | 5 | 0.13 | 80 | 3.82 | ○ | " |
| 106 | 6 | 0.14 | 40 | 3.10 | ○ | " |
| 107 | 8 | 0.13 | 101 | 3.61 | Δ | Comparison |
| 108 | 9 | 0.14 | 100 | 3.59 | Δ | " |
| 109 | 10 | 0.13 | 60 | 3.40 | Δ | " |
| 110 | 11 | 0.13 | 8 | 1.52 | X | " |
| 111 | 12 | 0.15 | 104 | 3.82 | ○ | Invention |
| 112 | 13 | 0.14 | 103 | 3.79 | ○ | " |
| 113 | 14 | 0.13 | 105 | 3.81 | ○ | " |
| 114 | 15 | 0.14 | 95 | 3.83 | ○ | " |

It is seen from Table 5 that when a hexacyano metal complex was used, the sensitivity and Dmax were high and the image preservability against light irradiation was improved.

EXAMPLE 4

An experiment was performed in the same manner as in Example 3 except that the silver amount in the emulsion was changed as shown in Table 6. The silver amount was shown by a relative value when the value of Sample 101 was 1.0. The results are shown together in Table 6.

TABLE 6

| Sample | Emulsion | Silver Amount | Fog | Sensitivity | Dmax | Evaluation of Image Preservability against Light Irradiation | |
|---|---|---|---|---|---|---|---|
| 101 | 1 | 1.0 | 0.14 | 100 | 3.60 | Δ | Comparison |
| 115 | 1 | 0.9 | 0.13 | 99 | 3.40 | Δ | " |
| 116 | 1 | 0.8 | 0.14 | 98 | 3.20 | Δ | " |
| 117 | 1 | 0.7 | 0.12 | 90 | 3.04 | ○ | " |
| 103 | 3 | 1.0 | 0.14 | 100 | 3.81 | ○ | Invention |
| 118 | 3 | 0.9 | 0.13 | 99 | 3.69 | ○ | " |
| 119 | 3 | 0.8 | 0.14 | 97 | 3.58 | ◎ | " |
| 120 | 3 | 0.7 | 0.12 | 40 | 3.40 | ◎ | " |
| 111 | 12 | 1.0 | 0.15 | 104 | 3.82 | ○ | " |
| 121 | 12 | 0.9 | 0.14 | 101 | 3.67 | ○ | " |
| 122 | 12 | 0.8 | 0.13 | 97 | 3.59 | ◎ | " |
| 123 | 12 | 0.7 | 0.12 | 54 | 3.38 | ◎ | " |

It is seen from Table 6 that by allowing a hexacyano metal complex of the present invention to be present on the outermost surface, the silver amount could be reduced and the image preservability against light irradiation could be more improved while keeping the same Dmax.

By allowing a hexacyano metal complex of the present invention to be present on the outermost surface, a silver halide emulsion comprising silver halide grains having a small grain size can be produced and a photothermographic material having high sensitivity and excellent image preservability against light can be provided.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising at least a dispersion medium and silver halide grains, wherein said silver halide grains have an average grain size of from 0.005 to 0.07 μm and a hexacyano metal complex represented by formula (I) is present on the outermost surface of the silver halide grain:

$$[M(CN)_6]^{n-} \quad \text{(I)}$$

wherein M represents Fe, Ru, Os, Co, Rh, Ir or Re, and n represents 3 or 4, and wherein the shape of the silver halide grains is selected from the group consisting of cubic form, octahedral form, spherical form, bar form and pebble form.

2. The silver halide emulsion as claimed in claim 1, wherein said silver halide grain contains in the inside thereof a coordination metal complex or metal ion containing a metal belonging to the elements of Group III to Group XIV of the Periodic Table.

3. The silver halide emulsion as claimed in claim 2, wherein said coordination metal complex or metal ion is added in an amount of from $1\times10^{-8}$ to $1\times10^{-3}$ mol per mol of silver.

4. The silver halide emulsion as claimed in claim 2, wherein said coordination metal complex or metal ion is added in an amount of from $1\times10^{-7}$ to $1\times10^{-4}$ mol per mol of silver.

5. The silver halide emulsion as claimed in claim 2, wherein said coordination metal complex contained in the inside of the silver halide grain is a compound represented by formula (III):

$$[M1(CN)_6]^{n1-} \quad \text{(III)}$$

wherein M1 represents Fe, Ru, Os, Co, Rh, Ir, Cr or Re, and n1 represents 3 or 4.

6. The silver halide emulsion as claimed in claim 2, wherein said coordination metal complex contained in the inside of the silver halide grain is an iridium complex.

7. The silver halide emulsion as claimed in claim 6, wherein said iridium complex is added in an amount of from $10^{-9}$ to $10^{-3}$ mol per mol of silver halide.

8. The silver halide emulsion as claimed in claim 1, wherein said silver halide emulsion is chalcogen sensitized.

9. The silver halide emulsion as claimed in claim 1, wherein said silver halide grains are formed in the presence of an oxidizing agent for silver.

10. The silver halide emulsion as claimed in claim 1, wherein said silver halide emulsion is chemically sensitized in the presence of a spectral sensitizing dye.

11. A silver halide light-sensitive material comprising a support having thereon at least one light-sensitive layer comprising the silver halide emulsion as claimed in claim 1.

12. A photothermographic material comprising a support having thereon at least one light-sensitive layer containing a light-sensitive silver halide, a light-insensitive silver salt of an organic fatty acid, a reducing agent for silver ion and a binder, wherein a silver halide emulsion as claimed in claim 1 is prepared independently of said silver salt of the organic fatty acid and mixed with said silver salt of the organic fatty acid at the coating and the mixture is coated and dried to form said light-sensitive layer.

13. The silver halide emulsion as claimed in claim 1, wherein M is selected from the group consisting of Fe and Ru.

14. The silver halide emulsion as claimed in claim 1, wherein M represents Fe.

15. The silver halide emulsion as claimed in claim 1, wherein the hexacyano metal complex is added after the addition of an aqueous silver nitrate solution used for the grain formation is completed but before starting the chemical sensitization process.

16. The silver halide emulsion of claim 1, wherein the silver halide grain is a regular crystal or is an irregular crystal.

17. The silver halide emulsion of claim 1, wherein the silver halide grain is a tabular grain.

18. A method for producing a silver halide emulsion comprising silver halide grains having an average grain size of from 0.005 to 0.07 $\mu$m, wherein a hexacyano metal complex represented by the following formula (I) is added after the addition of an aqueous silver nitrate solution used for the grain formation is completed but before starting the chemical sensitization process:

$$[M(CN)_6]^{n-} \quad (I)$$

wherein M represents Fe, Ru, Os, Co, Rh, Ir or Re, and n represents 3 or 4, and wherein the shape of the silver halide grains is selected from the group consisting of cubic form, octahedral form, spherical form, bar form and pebble form.

19. The method for producing a silver halide emulsion as claimed in claim 18, wherein said hexacyano metal complex is added in an amount of from $1\times10^{-5}$ to $1\times10^{-2}$ mol per mol of silver.

20. The method for producing a silver halide emulsion as claimed in claim 18, wherein said hexacyano metal complex is added in an amount of from $1\times10^{-4}$ to $1\times10^{-3}$ mol per mol of silver.

21. The method for producing a silver halide emulsion as claimed in claim 18, wherein the addition of said hexacyano metal complex is started after 96 wt % of the total amount of silver nitrate added for forming grains is added.

22. A silver halide emulsion comprising at least a dispersion medium and silver halide grains, wherein said silver halide grains have an average grain size of from 0.010 to 0.060 $\mu$m and a hexacyano metal complex represented by formula (I) is present on the outermost surface of the silver halide grain:

$$[M(CN)_6]^{n-} \quad (I)$$

wherein M represents Fe, Ru, Os, Co, Rh, Ir or Re, and n represents 3 or 4, and wherein the shape of the silver halide grains is selected from the group consisting of cubic form, octahedral form, spherical form, bar form and pebble form.

* * * * *